US008717150B2

(12) United States Patent
Egawa et al.

(10) Patent No.: US 8,717,150 B2
(45) Date of Patent: May 6, 2014

(54) ALARMING DEVICE

(75) Inventors: Yoshitaka Egawa, Tokyo (JP); Hiroshi Shima, Yokohama (JP)

(73) Assignee: Hochiki Corporation, Tokyo (JP)

( * ) Notice: Subject to any disclaimer, the term of this patent is extended or adjusted under 35 U.S.C. 154(b) by 560 days.

(21) Appl. No.: 12/988,064

(22) PCT Filed: Apr. 17, 2009

(86) PCT No.: PCT/JP2009/057771
§ 371 (c)(1),
(2), (4) Date: Oct. 15, 2010

(87) PCT Pub. No.: WO2009/133777
PCT Pub. Date: Nov. 5, 2009

(65) Prior Publication Data

US 2011/0032114 A1 Feb. 10, 2011

(30) Foreign Application Priority Data

May 1, 2008 (JP) ..... 2008-119583
May 15, 2008 (JP) ..... 2008-128182

(51) Int. Cl.
*G08B 17/00* (2006.01)

(52) U.S. Cl.
USPC ..... 340/286.05; 340/7.32; 340/506; 340/539.26; 340/539.3

(58) Field of Classification Search
USPC ..... 340/539.22, 539.26, 539.3, 506, 340/286.05, 628, 332, 539.27, 825.36, 340/286.02, 539.21, 7.5, 7.58, 7.32
See application file for complete search history.

(56) References Cited

U.S. PATENT DOCUMENTS 6,028,513 A * 2/2000 Addy ..... 340/539.16
2006/0128414 A1 6/2006 Shida et al.

(Continued)

FOREIGN PATENT DOCUMENTS

CN 1767257 A 5/2006
CN 101114400 A 1/2008

(Continued)

OTHER PUBLICATIONS

Japanese Patent Office; Search Report in International Patent Application No. PCT/JP2009/057771 dated Jun. 30, 2009; 7 pages.

(Continued)

*Primary Examiner* — Brent Swarthout
(74) *Attorney, Agent, or Firm* — Wood, Herron & Evans, LLP

(57) ABSTRACT

The alarming device of the present invention includes a battery power supply; a sensor section that outputs an anomaly detection signal in the case of detecting an anomaly; a alert section that outputs an anomaly alarm based on the anomaly detection signal; a reception circuit section that receives an event signal from another alarming device; a transmission circuit section that transmits an event signal to the other alarming device; an anomaly monitoring section that, when the sensor section has detected an anomaly, causes the alert section to output the anomaly alarm based on the anomaly detection signal and causes the transmission circuit section to transmit an event signal according to the anomaly of the alarming device to the other alarming device, and on the other hand, when the reception circuit section has received an event signal according to an anomaly of the other alarming device from the other alarming device, causes the alert section to output the anomaly alarm; and a communication control section that detects a predetermined event and performs communication control by adjusting the transmitting and receiving of an event signal by the transmission circuit section and the reception circuit section.

9 Claims, 17 Drawing Sheets

(56) References Cited

U.S. PATENT DOCUMENTS

| | | | | |
|---|---|---|---|---|
| 2007/0236358 | A1* | 10/2007 | Street et al. | 340/628 |
| 2007/0241876 | A1* | 10/2007 | Johnston et al. | 340/506 |

FOREIGN PATENT DOCUMENTS

| | | | |
|---|---|---|---|
| JP | 07-273721 | A | 10/1995 |
| JP | 11-055176 | A | 2/1999 |
| JP | 2004186865 | A | 7/2004 |
| JP | 2005-292969 | A | 10/2005 |
| JP | 2006-173691 | A | 6/2006 |
| JP | 2006-245666 | A | 9/2006 |
| JP | 2006-270505 | A | 10/2006 |
| JP | 2006-279822 | A | 10/2006 |
| JP | 2007-094719 | A | 4/2007 |
| JP | 2008-033841 | A | 2/2008 |
| JP | 2008-042383 | A | 2/2008 |
| WO | 2006044751 | A2 | 4/2006 |

OTHER PUBLICATIONS

European Search Report issued in European Patent Application No. 12158573.1, dated May 10, 2012, 8 pages.

Office Action issued in Chinese Patent Application No. 200980115095.9, mailed Aug. 14, 2012, 17 pages.

Notice of Allowance issued in Japanese Patent Application No. 2010-510081; Jun. 18, 2013; 7 pages.

Japanese Patent Office, Office Action issued in Application No. 2013-088758, mailed Nov. 26, 2013, 4 pp.

* cited by examiner

ALARMING DEVICE

TECHNICAL FIELD

The present invention relates to an alarming device that detects an anomaly such as fire and performs an alarm, and also wirelessly transmits a signal to other alarming devices to perform linked alarm output.

Priority is claimed on Japanese Patent Application No. 2008-119583, filed May 1, 2008, and Japanese Patent Application No. 2008-128182, filed May 15, 2008, the content of which are incorporated herein by reference.

BACKGROUND ART

Residential alarms (hereinbelow referred to as "alarming devices") that emit an alarm upon detecting an anomaly such as a fire, gas leak or the like have become prevalent, and in recent years, there has been an increasing trend to perform monitoring for anomalies such as fires in every room by installing a plurality of alarming devices in a single residence (for example, refer to Patent Document 1).

In this way, when a plurality of alarming devices have been installed in a residence, in the case of a person being present in a separate room from the room in which an anomaly has occurred, there is the risk of the alarm sound not being audible to that person. For that reason, one has been proposed in which a linked alarm is possible by connecting alarming devices with wires, and so in the case of one alarming device having detected a fire and emitting an alarm, it is possible to transmit an alarm signal from that alarming device to the other alarming devices to cause them to sound simultaneously.

However, since wiring work is required in order to connect the alarming devices with wires, the problem arises of higher cost. The problem can be solved by adopting wireless alarming devices. Moreover, due to the reduced power consumption of wireless integrated circuits, even if placed in an operating state of being capable of always receiving a signal in order to be capable of receiving an alarm signal from another alarming device, a battery life that can withstand practical usage of over, for example, five years, is ensured. Therefore, the environment for making wireless alarming devices commercially viable is being put into place.

In such a wireless alarming device, since it is not known when a signal indicating an anomaly will be transmitted from another alarming device, it is necessary to put the reception circuit section in a standby operation state in order to be able to receive a signal at anytime. However, since the power consumption becomes large by doing so, the reception operation is made to be performed discontinuously at every predetermined reception cycle.

Since there is no longer a need to always put the reception circuit section in a standby operation state with such a discontinuous reception operation, the current consumption of a reception circuit section decreases, and even if it is a wireless type alarming device, it is possible to guarantee a battery life exceeding five years.

In this discontinuous reception method, carrier sensing is performed by operating the reception circuit section at 10 second intervals. In the case of there being a carrier, the reception operation is continued for a fixed time required for signal reception, and then put in sleep mode, while if there is no carrier, it immediately enters the sleep mode.

In discontinuous reception by this kind of carrier sensing, shortening of the carrier sensing time is effective for reduction of the current consumption, and by utilizing a high-speed PLL synthesizer or the like, a cut in the current consumption is achieved by shortening by around 1 millisecond the required time for carrier sensing.

CITATION DOCUMENT

Patent Documents

[Patent Document 1] Japanese Unexamined Patent Application, First Publication No. 2007-094719

DISCLOSURE OF THE INVENTION

Problems to be Solved by the Invention

In a wireless alarming device, the battery life is extended by reducing the current consumption of the reception circuit section with a discontinuous reception operation. However, compared to an alarming device that does not have a wireless function, there is an increase in the current consumption by the section to operate the transmission and reception circuit section that performs discontinuous reception operations and transmission operations during anomaly detection, and so a shortening of the battery life cannot be avoided.

Therefore, the present invention has as its first object to provide an alarming device that can further extend battery life by reducing the current consumption of the transmission and reception circuit section as much as possible even if wireless.

Also, in carrier sensing for the discontinuous reception operation in a conventional alarming device, a carrier sensing threshold value is set in a fixed manner in order to judge the existence of a carrier. For that reason, in the case of the radio wave environment being poor at the location in which the alarming device is installed, the noise component is judged to be a carrier, and the reception operation ends up being continued for a fixed period of time. As a result, since it does not enter the sleep mode even though a carrier does not exist, the problem arises of excess current being consumed, and the battery life being reduced.

Therefore, the present invention has as its second object to provide an alarming device that can reduce current consumption in discontinuous reception that accompanies carrier sensing.

Means for Solving the Problems

The present invention adopts the following means in order to achieve the objects for solving the aforementioned issues.

That is, the alarming device according to the first aspect of the present invention is provided with a battery power supply; a sensor section that outputs an anomaly detection signal in the case of detecting an anomaly; a alert section that outputs an anomaly alarm based on the anomaly detection signal; a reception circuit section that receives an event signal from another alarming device; a transmission circuit section that transmits an event signal to the other alarming device; an anomaly monitoring section that, when the sensor section has detected an anomaly, causes the alert section to output the anomaly alarm based on the anomaly detection signal and causes the transmission circuit section to transmit an event signal according to the anomaly of the alarming device to the other alarming device, and on the other hand, when the reception circuit section has received an event signal according to an anomaly of the other alarming device from the other alarming device, causes the alert section to output the anomaly alarm; and a communication control section that detects a predetermined event and performs communication control by adjusting the transmission and reception of an event signal by the transmission circuit section and the reception circuit section.

In the alarming device of the aforementioned first aspect, the communication control section, upon detecting a predetermined event, may perform control that causes stoppage of the transmission of an event signal by the transmission circuit section and the reception of an event signal by the reception circuit section.

In the alarming device of the aforementioned first aspect, the communication control section, upon detecting a predetermined event, may perform control that lowers the transmission power by the transmission circuit section.

In the alarming device of the aforementioned first aspect, the communication control section, upon detecting a predetermined event, may perform control that stops the reception of an event signal by the reception circuit section.

In the alarming device of the aforementioned first aspect, the communication control section may detect as the predetermined event at least one of the following: a reduction in the voltage of the battery power supply to a predetermined value or less; a predetermined equipment malfunction of the alarming device; an anomaly of the transmission circuit section or the reception circuit section; a communication anomaly involving an event signal from the other alarming device; a stoppage of a regular report from the other alarming device; and a reduction in the communication radio waves from the other alarming device.

In the alarming device of the aforementioned first aspect, the reception circuit section may be constituted to receive an event signal from the other alarming device by discontinuously performing a reception operation at every predetermined reception period; and the transmission circuit section may be constituted to transmit to the other alarming device the event signal over a transmission time that is equal to or greater than the reception period.

The alarming device according to the second aspect of the present invention is provided with a sensor section that outputs an anomaly detection signal in the case of detecting an anomaly; a alert section that outputs an anomaly alarm based on the anomaly detection signal; a reception circuit section that receives an event signal from another alarming device by discontinuously performing a reception operation at every predetermined reception period; a transmission circuit section that transmits to the other alarming device the event signal over a transmission time that is equal to or greater than the reception period; an anomaly monitoring section that, when the sensor section has detected an anomaly, causes the alert section to output the anomaly alarm based on the anomaly detection signal and causes the transmission circuit section to transmit an event signal according to the anomaly of the alarming device to the other alarming device, and on the other hand, when the reception circuit section has received an event signal according to an anomaly of the other alarming device from the other alarming device, causes the alert section to output the anomaly alarm; a carrier signal strength measuring section that receives the event signal and measures the carrier signal strength; and a discontinuous reception control section that, when the reception circuit section starts the reception operation, causes the carrier signal strength measuring section to measure the carrier signal strength, and, in the case of the measured carrier signal strength being less than a predetermined carrier sensing threshold value, causes the reception operation of the reception circuit section to sleep, and on the other hand in the case of the measured carrier signal strength exceeding the carrier sensing threshold value, causes the reception operation of the reception circuit section to be performed over a predetermined time, with the predetermined carrier sensing threshold value being suitably changeable.

In the alarming device of the aforementioned second aspect, it may be further provided with a carrier sensing threshold value selecting section in which two carrier signal strength values of high and low are settable in advance as candidates of the carrier sensing threshold value, and by selecting either one of the two carrier sensing threshold value candidates that has been set, sets it as the carrier sensing threshold value.

In the alarming device of the aforementioned second aspect, it may be further provided with a carrier sensing threshold value setting section that finds the carrier sensing threshold value based on the carrier signal strength that is measured when the reception circuit section starts the reception operation.

In the alarming device of the aforementioned second aspect, the carrier sensing threshold value setting section may find the carrier sensing threshold value based on the average value of the carrier signal strength that is measured by the signal strength measurement section over a predetermined period.

Effects of the Invention

The alarming device of the first aspect of the present invention, upon detecting a predetermined event that cannot maintain normal transmission and reception operations, such as a reduction in the battery voltage to a predetermined value or less (low battery); a predetermined equipment malfunction; an anomaly of the transmission circuit section or the reception circuit section; a radio communication anomaly from the other alarming device; a stoppage of a regular report from the other alarming device; or a reduction in the radio waves from the other alarming device, it performs control such as stoppage of transmission and reception, reduction of transmission power, or stoppage of reception, and reduces current consumption of the transmission and reception circuit section. Thereby, even if the wireless linked alarm function with the other alarming devices is lost, it is possible to maintain the monitoring alarm function of a standalone alarming device. For that reason, it is possible to avoid as much as possible a non-alert state while extending as much as possible the battery life.

The alarming device according to the second aspect of the present invention, in the case of the radio wave environment being poor in that the noise component is great, selects the higher carrier sensing threshold value among the two carrier sensing threshold values of high and low that are set in advance by a selection operation such as a switch by the user and sets it to the discontinuous reception control section. Thereby, even in the case of the radio wave environment being poor due to the noise is great in the carrier frequency band, by setting the carrier sensing threshold value to high, the noise component is not detected as the carrier. For that reason, since continuation of the reception operation is prevented, and it can reliably enter the sleep mode without performing unnecessary carrier sensing, it is possible to reduce current consumption in discontinuous reception, and to extend the battery life.

Moreover, by automatically setting the carrier sensing threshold value from the carrier signal strength of the received event signal, it is possible to set a suitable carrier sensing threshold value that matches the radio wave environment of the installation location of the alarming device. For that reason, since it can reliably enter the sleep mode without performing unnecessary carrier sensing due to the noise component, it is possible to further extend the battery life.

BEST MODE FOR CARRYING OUT THE INVENTION (First Embodiment)

Figure 1B:
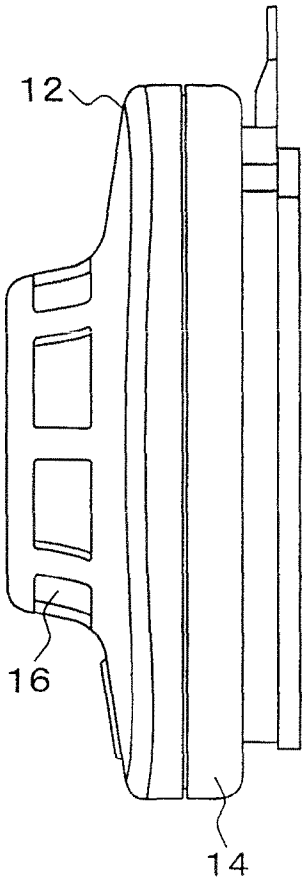
FIG. 1B is a side elevational drawing that shows the exterior appearance of the alarming device.
Figure 1A:
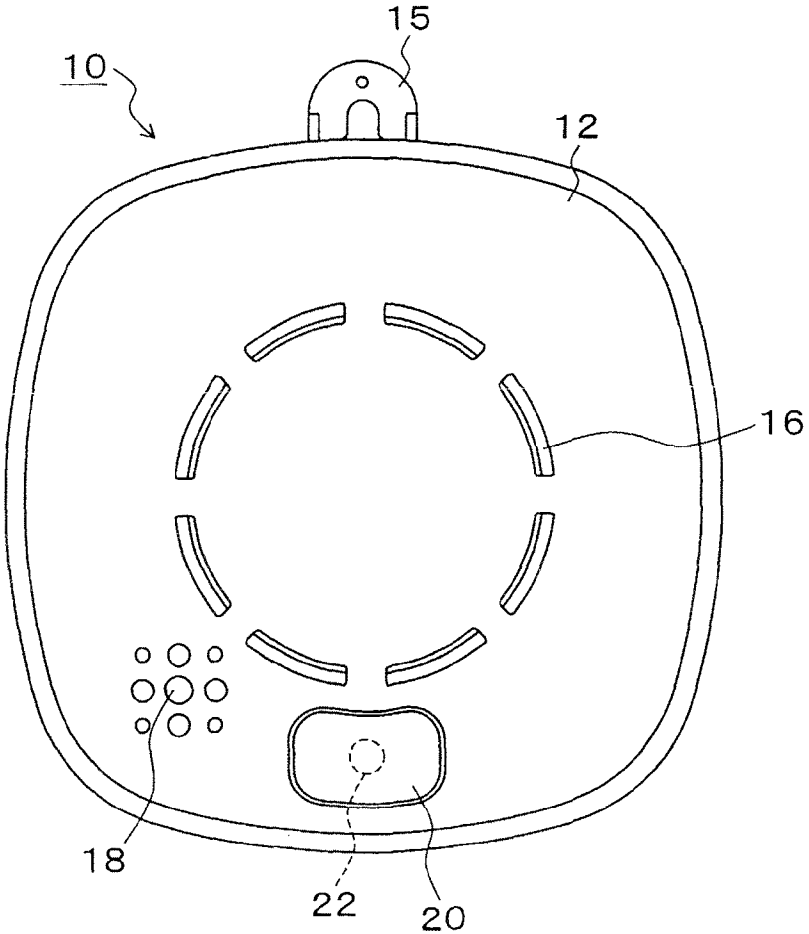
FIG. 1A is a front elevational drawing that shows the exterior appearance of the alarming device of the first embodiment of the present invention.

The exterior appearance of the wireless alarming device of the first embodiment of the present invention is shown in FIG. 1A and FIG. 1B, with FIG. 1A showing a front elevation, and FIG. 1B showing a side elevation.

In FIG. 1A and FIG. 1B, an alarming device 10 of the present embodiment is provided with a cover 12 and a main unit 14. A smoke detector section 16 in which openings that serve as smoke inlets are formed is arranged in the center of the cover 12, and when smoke from a fire reaches a predetermined density, it detects a fire.

As shown in FIG. 1A, a sound hole 18 is provided on the lower left side of the smoke detector section 16 of the cover 12. A speaker is built in at the rear of the sound hole 18 and outputs an alarm sound or voice message through this sound hole 18. An alarm stop switch 20 is provided on the lower side of the smoke detector section 16. The alarm stop switch 20 also has a function as a check switch.

An LED 22 as shown by the dotted line is arranged within the alarm stop switch 20. When the LED 22 turns on, the light therefrom passes through the section of the switch cover of the alarm stop switch 20, and so the turned on state of the LED 22 can be confirmed from outside.

A mounting hook 15 is provided on the upper section of the underside the main unit 14, and by screwing in a screw (not illustrated) into a wall of a room where it is to be installed, and attaching the mounting hook 15 onto this screw, it is possible to install the alarming device 10 on a wall.

Note that the alarming device 10 that is shown in FIG. 1A and FIG. 1B shows an example of the constitution that detects smoke from a fire with the smoke detector section 16, but in addition an alarming device that is provided with a thermistor that detects heat from a fire, or an alarming device that detects a gas leak besides a fire are included in the scope of the present invention.

Figure 2:
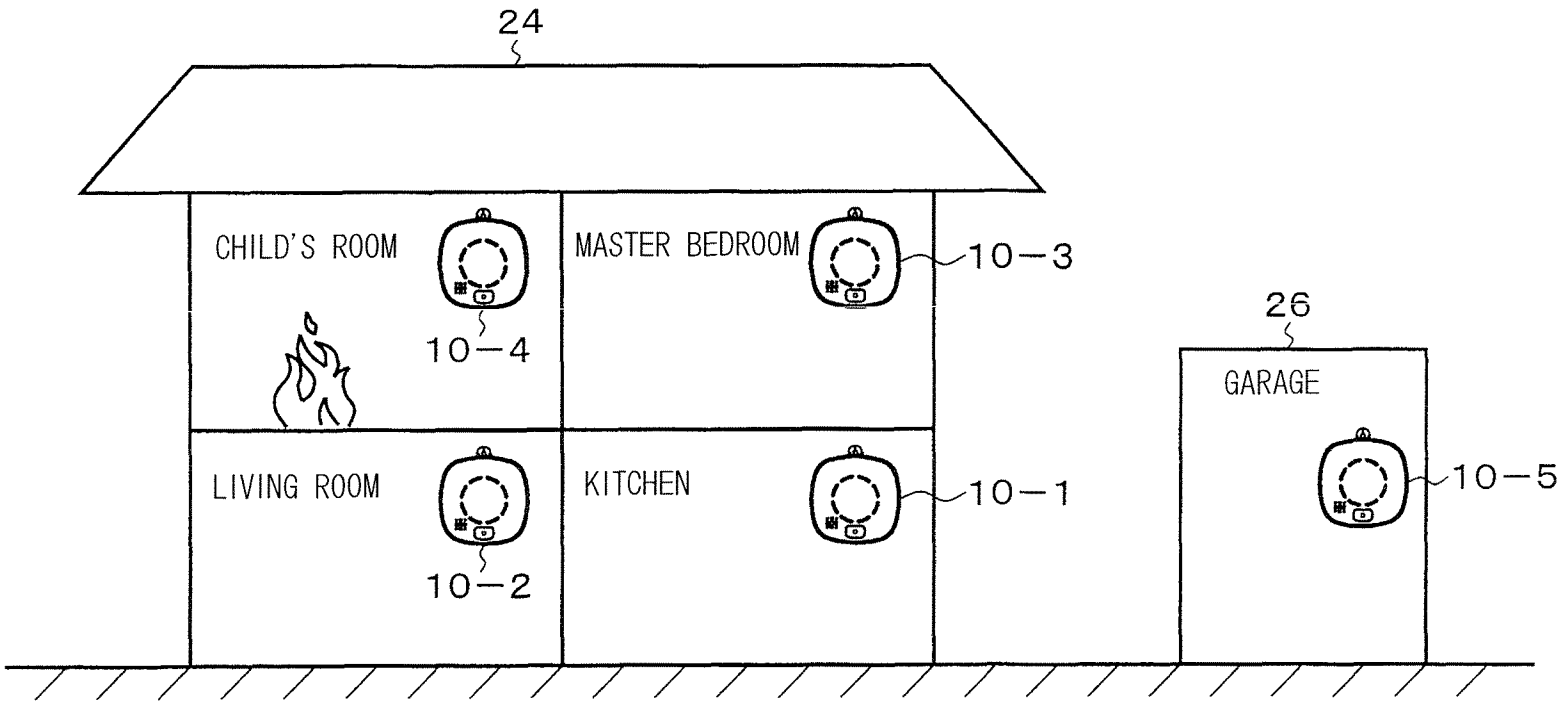
FIG. 2 is an explanatory drawing that shows the state of the alarming device installed in a residence.

FIG. 2 is an explanatory drawing that shows the state of the alarming device of the present embodiment installed in a residence. In the example of FIG. 2, alarming devices 10-1 to 10-4 of the present embodiment are installed in the kitchen, living room, master bedroom, and a child's room of a residence 24, and moreover, an alarming device 10-5 is installed in a garage 26 that is built outside.

The alarming devices 10-1 to 10-5 are each provided with a function to mutually transmit and receive wirelessly an event signal, and the five alarming devices 10-1 to 10-5 constitute one group to perform fire monitoring of the entire residence 24.

In the case of a fire occurring for example in the child's room of the residence 24, the alarming device 10-4 detects the fire and starts an alarm. The detection of the fire and starting of the alarm is called "alarm activation" in the alarming device. When the alarming device 10-4 activates an alarm, the alarming device 10-4 functions as the link source, and transmits wirelessly the event signal that indicates a fire alarm activation to the other alarming devices 10-1 to 10-3 and 10-5 that serve as link destinations. When the other alarming devices 10-1 to 10-3 and 10-5 receive the event signal that indicates fire alarm activation from the alarming device 10-4 that is the link source, they perform an alarm operation as link sources.

As the alarm sound of the alarming device 10-4 that is the link source, for example, the voice message "Woo Woo . . . The fire alarm has been activated. Please confirm" is output continuously. Meanwhile, in the link destination alarming devices 10-1 to 10-3 and 10-5, the voice message "Woo Woo . . . Another fire alarm has been activated. Please confirm" is output continuously. In the state of the alarming devices 10-1 to 10-5 outputting the alarm sound, when the alarm stop switch 20 that is provided on the alarming device shown in FIG. 1A is operated, the stop process of the alarm sound is performed.

Also, the alarming devices 10-1 to 10-5 are provided with a failure monitoring function, and when it detects a failure, for example, it intermittently outputs a "beep" alarm sound at a predetermined time interval, and reports that a failure has occurred. Also, the failure source alarming device that has detected the failure wirelessly transmits an event signal that indicates a failure occurrence to the other alarming devices, and in the other alarms units as well, the same failure alarm is output. As a result, when a failure is detected in any alarming device, a failure alarm is output from all of the alarming devices that constitute the group that performs linked alarms.

The failure alarm that is output from the alarming device can be stopped by operating the alarm stop switch 20. In the present embodiment, failures that are detected by the alarming device and set off an alarm are chiefly low battery alarms that warn of the detection of a drop in battery voltage, and also include a failure alarm such as a sensor failure in the smoke detector section or the like.

Figure 3:
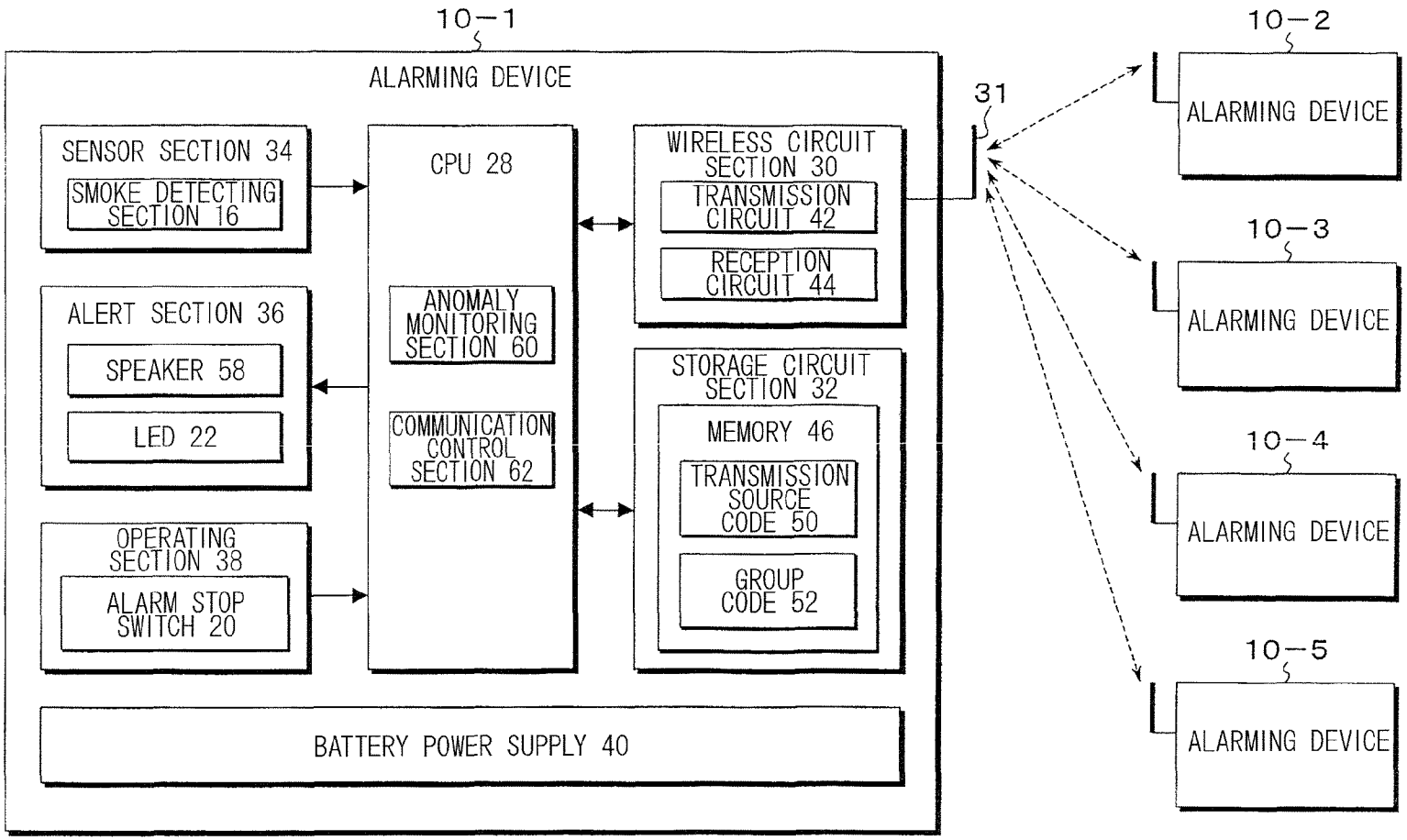
FIG. 3 is a block diagram of the alarm system that is used in the alarming device.

FIG. 3 is a block diagram that shows the constitution of the alarming device of the present embodiment. FIG. 3 shows in detail the circuit configuration of the alarming device 10-1, among the five alarming devices 10-1 to 10-5 shown in FIG. 2.

The alarming device 10-1 is provided with a CPU 28. Also, corresponding to this CPU 28, it is further provided with a wireless circuit section 30 that is provided with an antenna 31, a storage circuit section 32, a sensor section 34, a alert section 36, an operating section 38, and a battery power supply 40.

The wireless circuit section 30 is provided with a transmission circuit 42 and a reception circuit 44, and is designed to be capable of wirelessly transmitting and receiving event signals to/from the other alarming devices 10-2 to 10-5. As the wireless circuit section 30, in Japan it is preferable to adopt a constitution based on for example STD-30, which is known as the standard for specified low-power radio stations in the 400 MHz band (ARIB Standard for Radio Equipment for Radio Station of Low Power Security System), or STD-T67 (ARIB Standard for Telemeter, Telecontrol and Data Transmission Radio Equipment for Specified Low Power Radio Stations).

Of course, as the wireless circuit section 30, for places outside of Japan, it is preferable to adopt a constitution that is based on the standard for allocated radio stations of that region.

The reception circuit 44 performs a discontinuous reception operation. The discontinuous reception operation of the reception circuit 44 consists of a reception operation time of for example T1=5 milliseconds, followed by a sleep time of for example T2=10 seconds, resulting in discontinuous reception with a cycle T12 (=T1+T2). Corresponding to this discontinuous reception, the transmission circuit 42 continuously transmits the event signal over time T4 that is at least the discontinuous reception cycle T12 (=T1+T2).

Moreover, the transmission circuit 42 and the reception circuit 44 of the present embodiment can stop the transmission operation and reception operation by a control instruction from the CPU 28.

A memory 46 is provided in the storage circuit section 32. A transmission source code 50 that serves as an ID (identifier) that specifies the alarming device, and a group code 52 for constituting a group that performs a linked alarm with a plurality of alarms as shown in FIG. 2 is housed in the memory 46. As for the transmission source code 50, the number of alarming devices to be provided domestically is calculated, and for example a code of 26 bits is used so that the same code does not overlap.

The group code 52 is a code that is set so as to be common for the plurality of alarming devices that constitute a group, and when the group code that is included in the event signal from another alarming device that is received by the wireless circuit section 30 matches the group code 52 that is registered in the memory 46, that event signal is received as a valid signal and processed.

Note that in the present embodiment, the memory 46 is used in the storage circuit section 32, but a DIP switch may be provided instead of the memory 46, so that the transmission source code 50 and the group code 52 may be set by this DIP switch. In the case of the bit length (bit number) of the transmission source code 50 and the group code 52 being short, the storage circuit section 32 that uses a DIP switch is preferred.

In the present embodiment, the smoke detector section 16 is provided in the sensor section 34, and outputs a smoke detection signal corresponding to the smoke density to the CPU 28. Besides the smoke detector section 16, a thermistor that detects the temperature from a fire may be provided. Also, in the case of an alarming device for detecting gas leaks, a gas leak sensor is provided in the sensor section 34.

The speaker 58 and the LED 22 are provided in the alert section 36. The speaker 58 outputs a voice message from a speech synthesis circuit section that is not illustrated or an alarm sound. The LED 22, by blinking and flashing, or turning on, indicates an anomaly such as a fire or a failure.

The alarm stop switch 20 is provided in the operating section 38. When the alarm stop switch 20 is operated, it is possible to stop the alarm sound that is sounding from the alarming device 10-1. The alarm stop switch 20 also doubles as a check switch in the present embodiment.

The alarm stop switch 20 is in effect when the alert section 36 is outputting an alarm sound from the speaker 58. On the other hand, during the normal monitoring state when an alarm sound is not being output, the alarm stop switch 20 functions as a check switch, and when the check switch is pushed, a voice message for inspection is output from the alert section 36.

The battery power supply 40 uses for example alkaline dry cells of a predetermined number, and regarding the battery capacity, a battery service life of about 10 years is ensured due to the reduced power consumption of the entire circuit section including the wireless circuit section 30 in the alarming device 10-1.

In the CPU 28, an anomaly monitoring section 60 and a communication control section 62 are provided as functions that are realized by program execution.

When the smoke detection signal from the smoke detector section 16 of the sensor section 34 exceeds the fire level and detects a fire, the anomaly monitoring section 60 causes the repeated output of, for example, "Woo Woo . . . The fire alarm has been activated. Please confirm" as the voice message that is the alarm sound indicating the link source from the speaker 58 of the alert section 36, and transmits an event signal that indicates fire alarm activation from the antenna 31 to the other alarming devices 10-2 to 10-5 by the transmission circuit 42 of the wireless circuit section 30.

When an event signal that indicates fire alarm activation has been received from any of the other alarming devices 10-2 to 10-5 by the reception circuit 44 of the wireless circuit section 30, the anomaly monitoring section 60 causes the voice message "Woo Woo . . . Another fire alarm has been activated. Please confirm" to be output continuously from the speaker 58 of the alert section 36 as an alarm sound indicating the link destination.

Here, when the anomaly monitoring section 60 has detected a fire alarm activation and outputs the link source alarm sound, the LED 22 of the alert section 36 is made to blink, for example. On the other hand, in the case of outputting a link destination alarm sound, the LED 22 of the alert section 36 is made to flash. Thereby, it is possible to distinguish the indication of the LED 22 in the link source alarm and the link destination alarm. Of course, either of the link source alarm and the link destination alarm may be a blinking or flashing display of the LED 22.

Also, when the anomaly monitoring section 60 has detected as a failure a low battery due to a voltage drop of the battery power supply 40, it transmits to the other alarming devices 10-2 to 10-5 an event signal that indicates a failure, together with causing the output of a failure alarm sound by outputting a short low battery alarm sound such as a "beep" once every minute, for example.

A low battery is detected when the battery voltage has dropped to a limit voltage at which the alarming device is capable of normally functioning over, for example, 72 hours.

Also, when an event signal indicating a low battery has been received from any of the other alarming devices 10-2 to 10-5, by intermittently outputting a low battery alarm sound in the same manner, the anomaly monitoring section 62 performs linked output of the failure alarm sound. Warning of a low battery to the link destinations may consist of causing the LED 22 to blink in synchronization with the alarm sound.

The communication control section 62 stops the transmission and reception operation by the wireless circuit section 30 in the case of detecting a predetermined event. Predetermined events that stop the transmission and reception operation by the wireless circuit section 30 include for example the following:

(1) a low battery in which the battery voltage drops to below a predetermined value or below;

(2) a predetermined equipment failure or anomaly of the transmission and reception circuit section;

(3) an anomaly in wireless communication from another alarming device;

(4) stoppage of a regular report from another alarming device, or (5) a reduction in the wireless radio waves from another alarming device.

These predetermined events that stop the transmission/reception operation of the wireless circuit section 30, besides the low battery of (1), are cases of detecting a failure in wireless communication for performing linked alarms.

Also, for (4), it is necessary to provide a regular reporting function in the alarming devices 10-1 to 10-5 of the present embodiment. In the regular reporting function, each of the alarming devices 10-1 to 10-5 at every predetermined time, for example, once every 24 hours, transmits a regular reporting event signal at a randomly shifted timing. In the case of receiving a regular reporting event signal from the other alarming devices that belong to the same group that is registered in advance within 24 hours, it is judged to be normal. On the other hand, if a single regular reporting event signal could not be received even after the passage of, for example, 25 hours, there is judged to be a stoppage of regular reporting.

As the stop control of the transmission and reception operation of the wireless circuit section 30 by the communication control section 62, a switching circuit is provided in the power supply line from the battery power supply 40 corresponding to the wireless circuit section 30. By stopping the power supply by turning OFF the switching circuit with a control signal from the CPU 28, the operation of the transmission circuit 42 and the discontinuous reception operation of the reception circuit 44 are stopped.

By stopping the transmission and reception operation of the wireless circuit section 30 when any of the predetermined events of (1) to (5) is detected, since the reception circuit 44 thereafter does not perform the discontinuous reception operation, it is possible to reduce the consumed current of the battery power supply 40 by that section. Also, even if a fire or failure arises, since the transmission operation of an event signal is not performed by the transmission circuit 42, it is possible to reduce the current consumption of the battery power supply 40 by that section. Also, following the stoppage of the transmission and reception operation of the wireless circuit section 30, the alarming device 10-1 can continue fire monitoring in the installation location as an independent alarming device, even though the linked alarm by wireless communication is no longer possible, and it is possible to reduce the consumed current due to the stoppage of the transmission and reception operation of the wireless circuit section 30. For that reason, compared to the case of maintaining the transmission and reception operation, it is possible to ensure a longer battery life.

Figure 4:
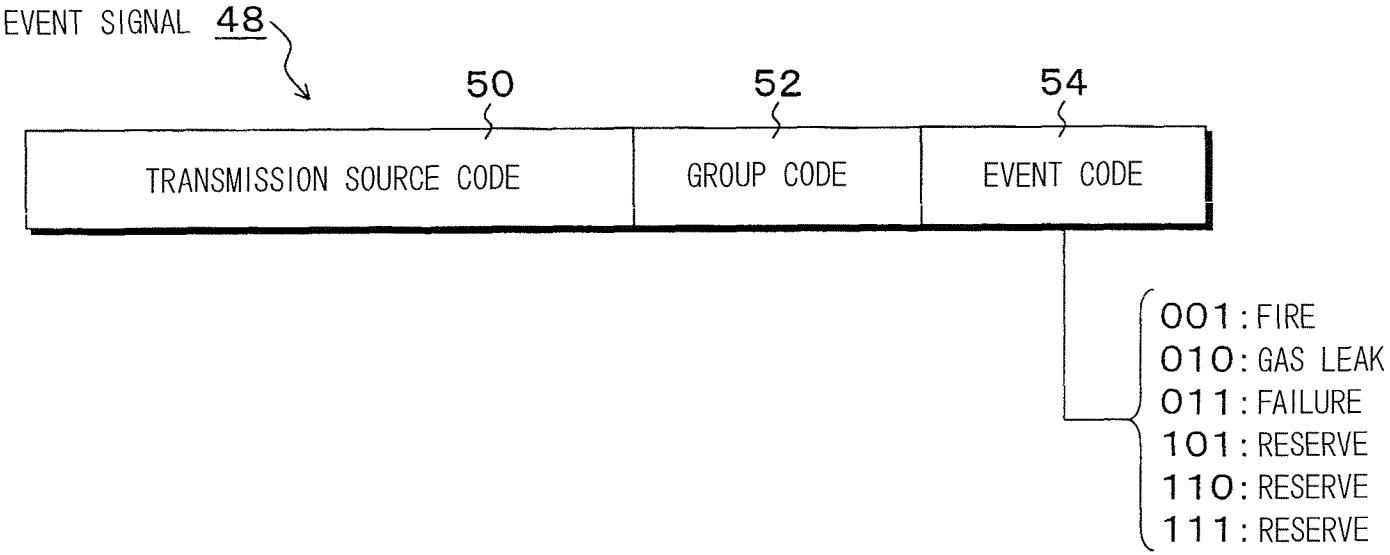
FIG. 4 is an explanatory drawing that shows the format of the event signal that is used in the embodiment.

FIG. 4 is an explanatory drawing that shows the format of the event signal used in the present embodiment. An event signal 48 as shown in FIG. 4 is constituted by the transmission source code 50, the group code 52, and the event code 54. The transmission source code 50 is for example a code of 26 bits. Also, the group code 52 is for example a code of 8 bits, and the same group code is set for the five alarming devices 10-1 to 10-5 of FIG. 3, for example, that constitute the same group.

Note that as the group code 52, the same group code may be set for each alarming device of the same group, but in addition, it may be a group code differing for each alarming device that is found from arithmetic of a reference code that is common to each alarming device that constitutes a group that is defined in advance, and a transmission source code that is unique to each alarming device.

The event code 54 is a code that expresses the event convent of an anomaly such as a fire or gas leak or a failure. In the present embodiment, a three-bit code is used, with for example "001" denoting a fire, "010" denoting a gas leak, "011" denoting a failure, and the remainder serving as a reserve.

Note that by increasing the bit number of the event code 54 to four bits or five bits when the type of events has increased, it is possible to express several types of event contents.

Figure 5:
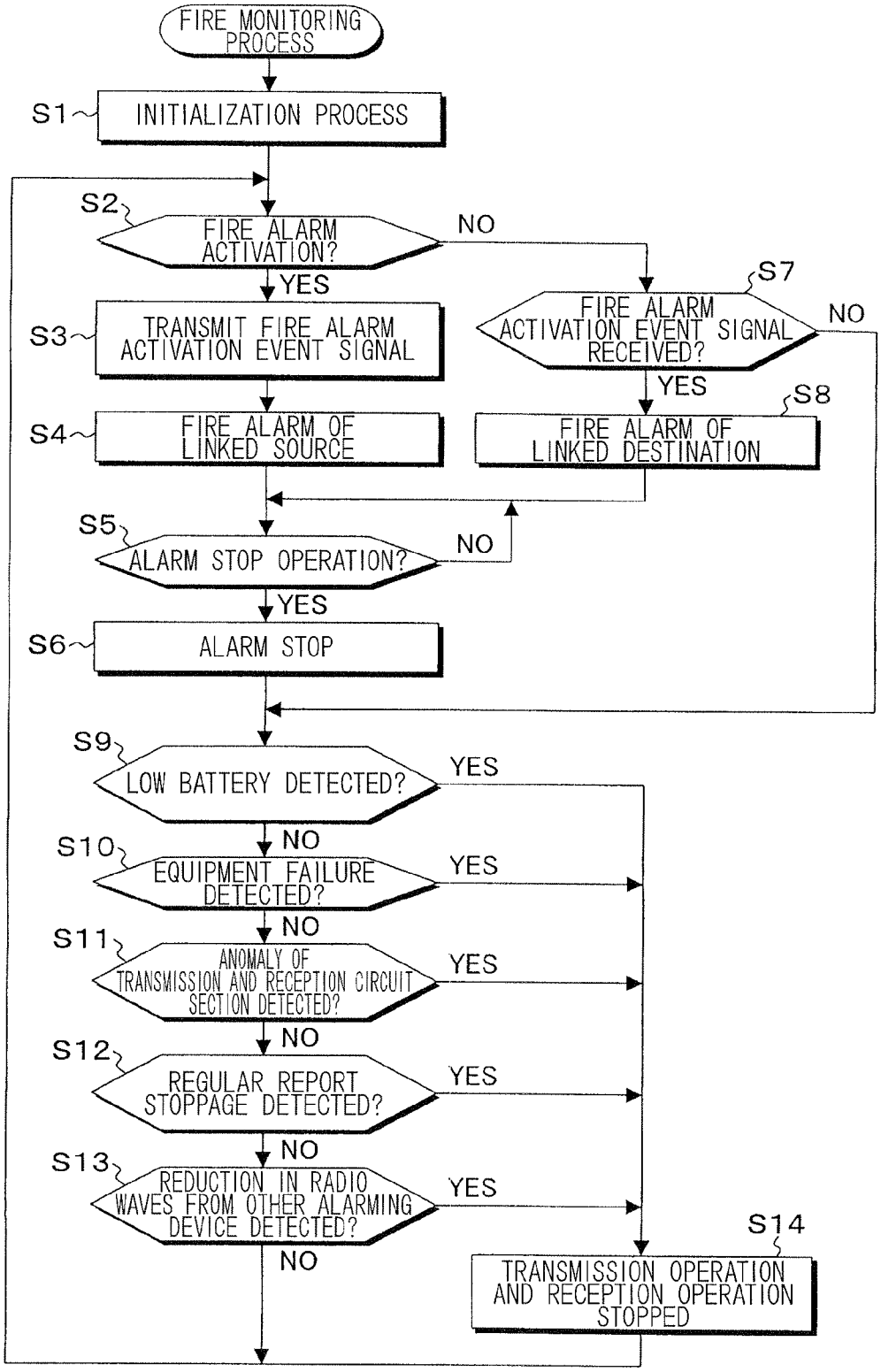
FIG. 5 is a flowchart that shows the fire monitoring process in the embodiment by the CPU of FIG. 3.

FIG. 5 is a flowchart that shows the fire monitoring process by the CPU 28 that is provided in the alarming device 10-1 of FIG. 3. First, when the battery power supply of the alarming device is turned ON, in Step S1, an initialization process is performed. This initialization process includes the setting of the group code for constituting a linked alarm group with the other alarming devices 10-2 to 10-5.

Next, the alarming device enters the monitoring state, and in Step S2, it is determined whether or not a preliminary anomaly has been detected. Specifically, the presence of a fire alarm activation is determined by whether or not the smoke detection signal from the smoke detector section 16 of the sensor section 34 exceeds a predetermined fire level.

In Step S2, in the case of a fire alarm activation being determined, the process proceeds to Step S3. In Step S3, after an event signal of fire alarm activation is transmitted to the other alarming devices 10-2 to 10-5, in Step S4, the fire alarm activation is acoustically output from the speaker 58 of the alert section 36 of each alarming device 10-2 to 10-5 of the link destination, and the LED 22 is controlled to turn on.

After each alarming device 10-2 to 10-5 of the link destination performs the fire alarm activation, in Step S5, the presence of an alarm stop operation by the alarm stop switch 30 is determined. Then, if there is an alarm stop operation, the alarm stoppage is performed in Step S6.

Meanwhile, in the case of a fire alarm activation not being determined in Step S2, in Step S7, the presence of the reception of a fire alarm activation event signal from the other alarming devices 10-2 to 10-5 is checked. In the case of the reception of a fire alarm activation event signal being determined, the fire alarm activation of the link destination is output in Step S8, and the process proceeds to Step S5. Then, if there is an alarm stop operation in Step S5, the alarm activation is stopped in Step S6.

Then, in Step S9, the presence of low battery detection is determined. In the case of low battery detection being determined, the process proceeds to Step S14, and the transmission operation of the transmission circuit 42 and the discontinuous reception operation of the reception circuit 44 that are provided in the wireless circuit section 30 are stopped, whereby the current consumption of the battery power supply 40 that is in the low battery state is held down so as to extend the battery life as much as possible.

Also, in Step S10, in the case of an equipment failure of the sensor 16 or the like being detected, the process similarly proceeds to Step S14, and the transmission operation of the transmission circuit 42 and the discontinuous reception operation of the reception circuit 44 that are provided in the wireless circuit section 30 are stopped, whereby the current consumption of the battery power supply 40 is held down so as to extend the battery life as much as possible.

Also, in Step S11, in the case of an anomaly in the wireless circuit section 30 being detected, the process similarly proceeds to Step S14, and by stopping the transmission operation of the transmission circuit 42 and the discontinuous reception operation of the reception circuit 44 that are provided in the wireless circuit section 30, the current consumption of the battery power supply 40 is held down so as to extend the battery life as much as possible.

Also, in Step S12, in the case of detecting the stoppage of regular reporting from the other alarming devices 10-2 to 10-5, the process similarly proceeds to Step S14, and by stopping the transmission operation of the transmission circuit 42 and the discontinuous reception operation of the reception circuit 44 that are provided in the wireless circuit section 30, the current consumption of the battery power supply 40 is held down so as to extend the battery life as much as possible. Note that in the case of a regular reporting function not being provided in the alarming devices 10-1 to 10-5, the processing of Step S12 is skipped.

Also, in Step S13, in the case of determining an anomaly of the transmission and reception circuit section 30, the process similarly proceeds to Step S14, and by stopping the transmission operation of the transmission circuit 42 and the discontinuous reception operation of the reception circuit 44 that are provided in the wireless circuit section 30, the current consumption of the battery power supply 40 is held down so as to extend the battery life as much as possible.

A drop in the received radio wave from the other alarming devices 10-2 to 10-5 is detected by the CPU 28 reading in the radio wave strength that is measured by a signal strength measurement section that is provided in the reception circuit 44. In the case of the radio wave strength that has been measured by the signal strength measurement section being below a predetermined threshold strength, it is determined to be a drop in the received radio wave.

The threshold strength that is used for the judgment of the radio wave strength is made to be a value that for example includes a margin from the reception sensitivity of the reception circuit 44. The reception sensitivity is the minimum value of the strength of the radio waves that enable the normal reception of a signal in the reception circuit 44, and is, for example, −110 dBm.

Figure 6:
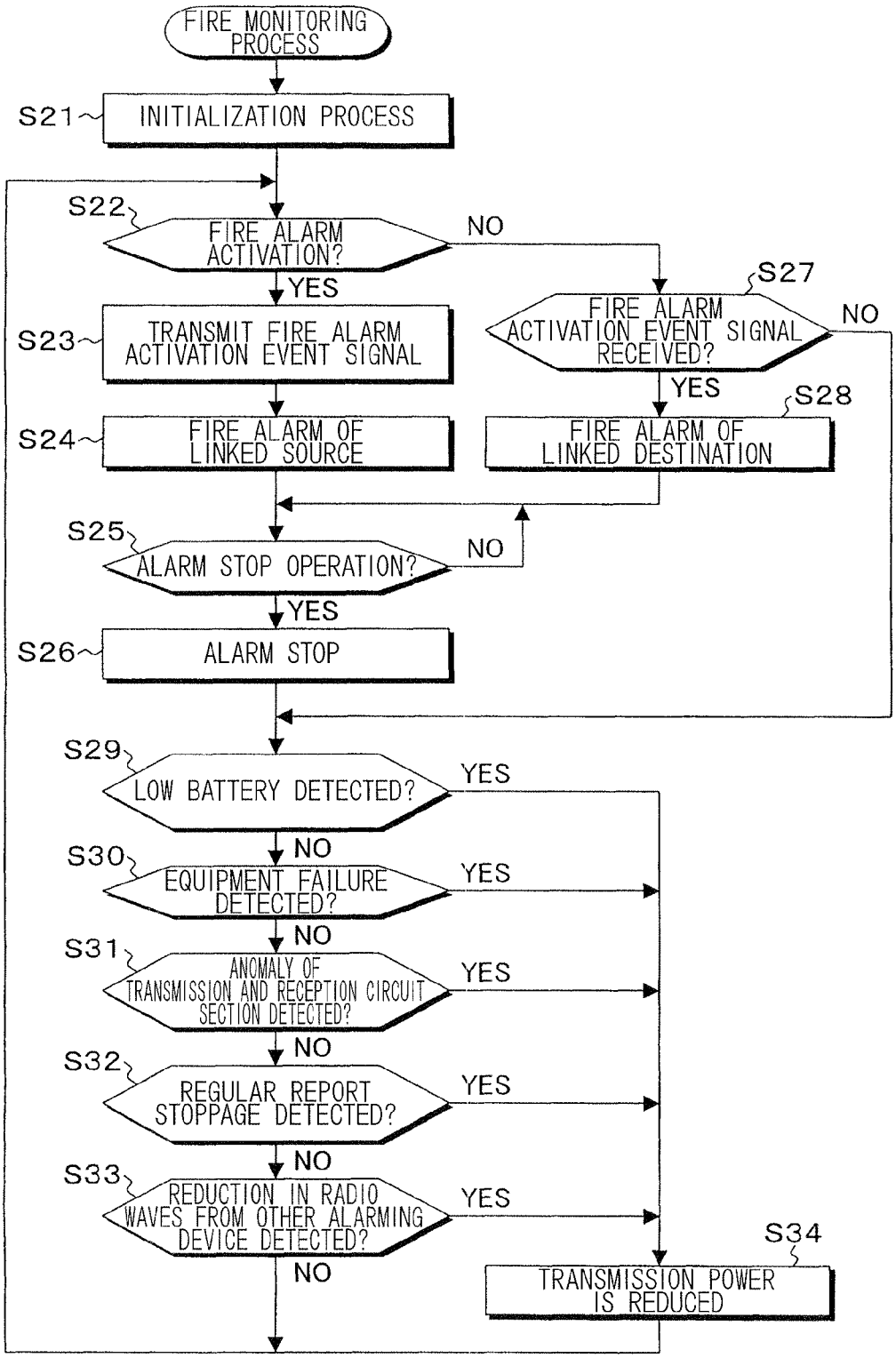
FIG. 6 is a flowchart that shows the fire monitoring process in another embodiment by the CPU of FIG. 3.

FIG. 6 is a flowchart that shows the fire monitoring process of another embodiment by the CPU 28 that is provided in the alarming device 10-1 of FIG. 3. This embodiment is characterized by lowering the transmission power in the case of detecting a predetermined event among the aforementioned (1) to (5).

In FIG. 6, the processes of Steps S21 to S33 are the same as the processes of Steps S1 to S13 of FIG. 5. In the process of Step S34, the transmission power by the transmission circuit 42 that is provided in the transmission and reception circuit section 30 is reduced. That is, in Steps S29 to S33, in the case of any one of the predetermined events among the aforementioned (1) to (5) being detected, in Step S34, by lowering the normal transmission power of 10 mW by the transmission circuit 42 to for example 1 mW, the current consumption of the transmission circuit 42 is reduced so as to extend the battery life as much as possible.

Figure 7:
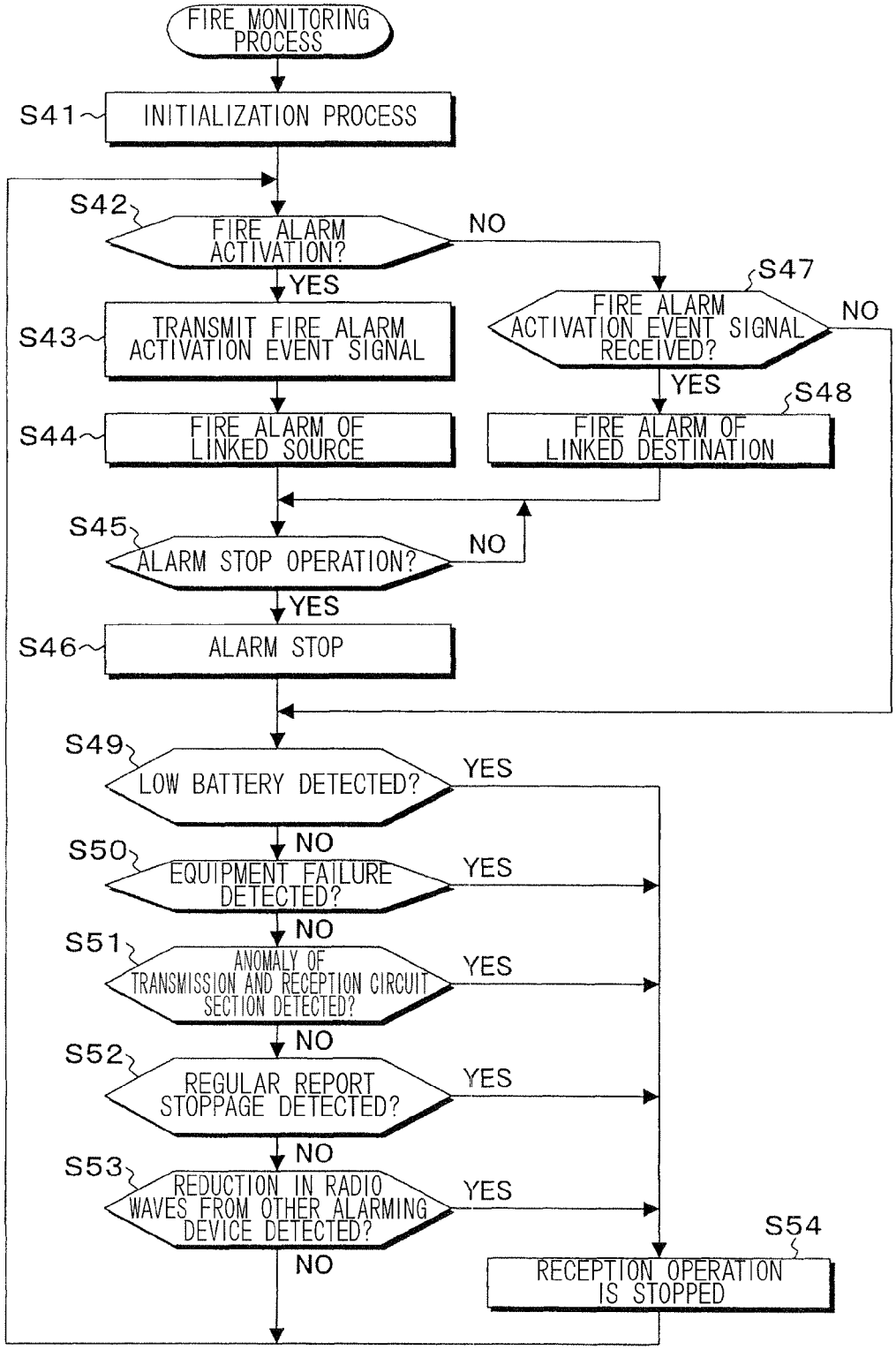
FIG. 7 is a flowchart that shows the fire monitoring process in another embodiment by the CPU of FIG. 3.

FIG. 7 is a flowchart that shows the fire monitoring process of another embodiment by the CPU 28 that is provided in the alarming device 10-1 of FIG. 3. In this embodiment, in the case of detecting a predetermined event among the aforementioned (1) to (5), the reception operation is stopped.

In FIG. 7, the processes of Steps S41 to S53 are the same as the processes of Steps Si to S13 of FIG. 5. In the process of Step S54, the discontinuous reception operation by the reception circuit 44 that is provided in the wireless circuit section 30 is stopped. That is, in the case of any one of the predetermined events among the aforementioned (1) to (5) being detected in Steps S49 to S53, in Step S54, by stopping the discontinuous reception operation by the reception circuit 44, the battery life is extended as much as possible.

The stoppage of the reception operation of this reception circuit 44 can extend the battery life even more since the degree of reduction in the current consumption is greater than the drop in transmission power in the case of the embodiment of FIG. 6.

Note that in the aforementioned embodiment, an alarming device intended for fire detection was taken as an example, but even for alarming devices that detect other anomalies, such as an alarming device for gas leaks or an alarming device for crime prevention, it is possible to apply as is the monitoring process that includes the preliminary anomaly of the present embodiment. Also, it is not limited to residences, and can be also applied to alarming devices for various uses such as for buildings and offices.

Also, the aforementioned embodiment is one that takes as an example the case of the sensor section being integrally provided in the alarming device, but as another embodiment it may also be an alarming device in which the sensor section is provided separately from the alarming device.

Also, the present invention is not limited to the aforementioned embodiment, and includes suitable transformations that do not impair the objects and advantages thereof, and moreover shall not be subject to limitations by only the values shown in the aforementioned embodiment.

(Second Embodiment)

Figure 8B:
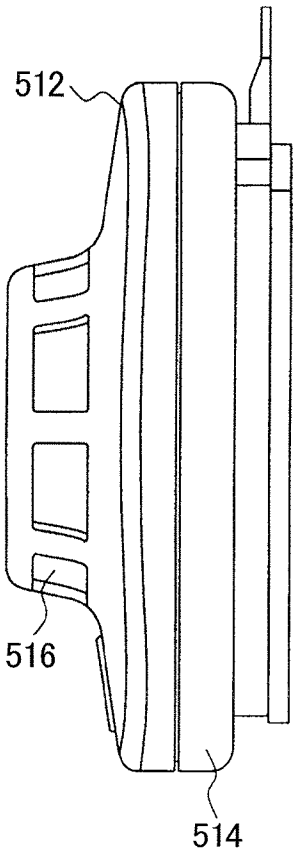
FIG. 8B is a side elevational drawing that shows the exterior appearance of the alarming device of the embodiment.
Figure 8A:
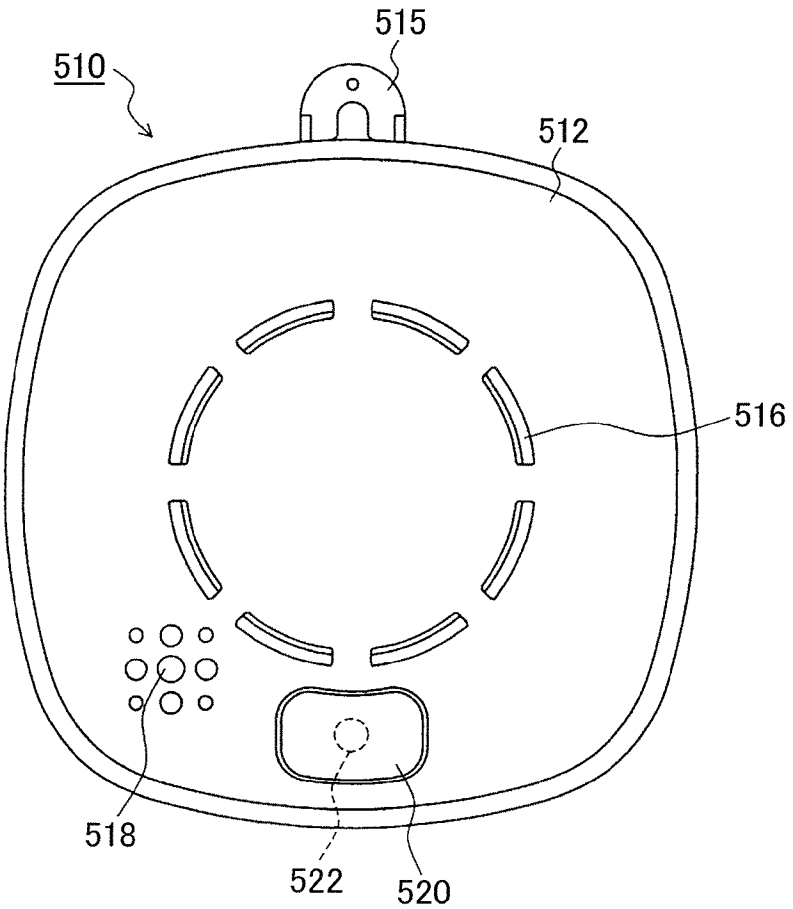
FIG. 8A is a front elevational drawing that shows the exterior appearance of the alarming device of the second embodiment of the present invention.

FIG. 8A and FIG. 8B show the exterior appearance of the wireless alarming device of the second embodiment of the present invention, with FIG. 8A showing a front elevation, and FIG. 8B showing a side elevation.

In FIG. 8A and FIG. 8B, an alarming device 510 of the present embodiment is provided with a cover 512 and a main unit 514. A smoke detector section 516 in which openings that serve as smoke inlets are formed is arranged in the center of the cover 512, and when smoke from a fire reaches a predetermined density, it detects a fire.

As shown in FIG. 8A, a sound hole 518 is provided on the lower left side of the smoke detector section 516 of the cover 512. A speaker is built in at the rear of the sound hole 518 and is designed to be able to output an alarm sound or voice message through this sound hole 518. An alarm stop switch 520 is provided on the lower side of the smoke detector section 516. The alarm stop switch 520 also has a function as a check switch.

An LED 522 as shown by the dotted line is arranged within the alarm stop switch 520. When the LED 522 turns on, the light therefrom passes through the section of the switch cover of the alarm stop switch 520, and so the turned on state of the LED 522 can be confirmed from outside.

An mounting hook 515 is provided on the upper section of the underside the main unit 514, and by screwing in a screw (not illustrated) into a wall of a room where it is to be installed, and attaching the mounting hook 515 onto this screw, it is possible to install the alarming device 510 on a wall.

Note that the alarming device 510 that is shown in FIG. 8A and FIG. 8B shows an example of the constitution that detects with the smoke detector section 516, but in addition an alarming device that is provided with a thermistor that detects heat from a fire, or an alarming device that detects a gas leak besides a fire are included in the scope of the present invention.

Figure 9:
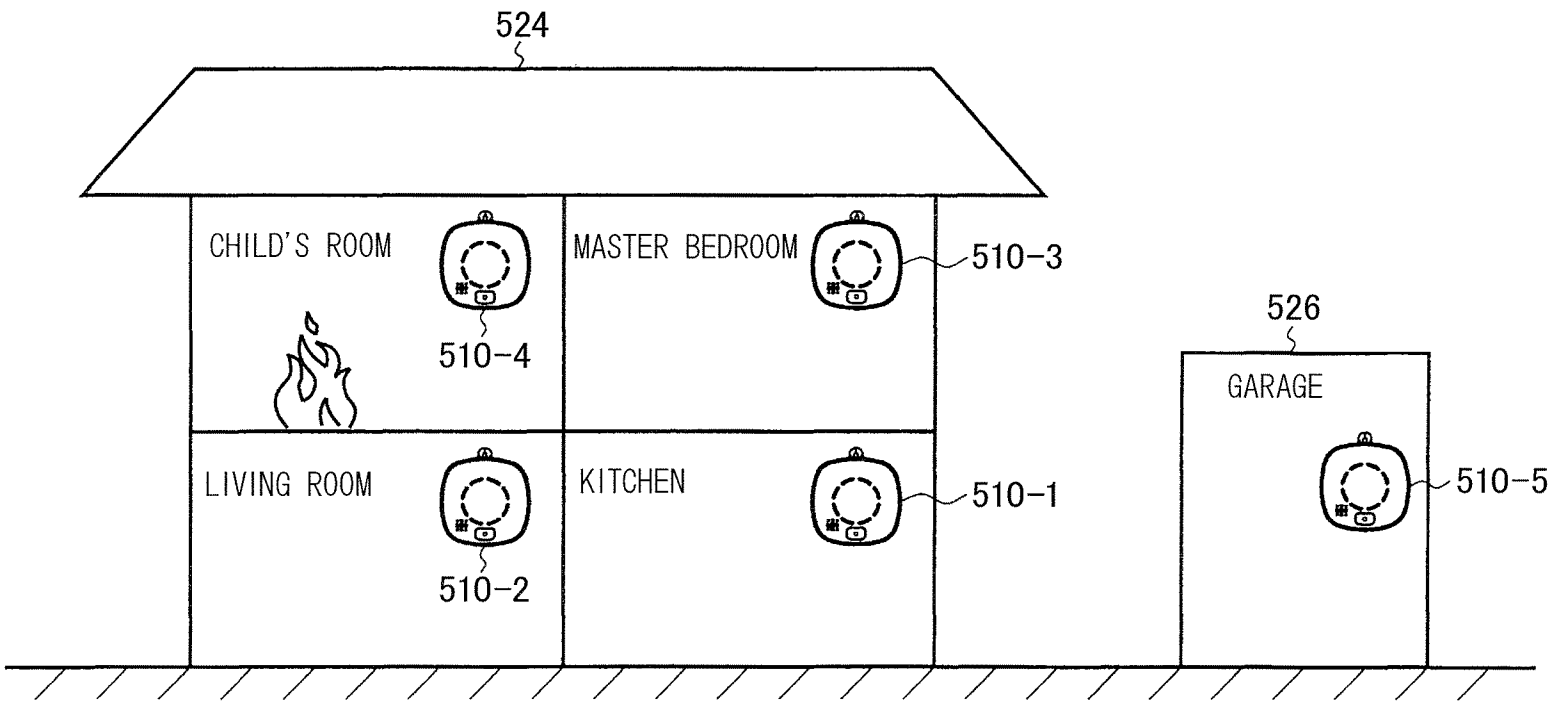
FIG. 9 is an explanatory drawing that shows the state of the alarming device installed in a residence.

FIG. 9 is an explanatory drawing that shows the state of the alarming device of the present embodiment installed in a residence. In the example of FIG. 9, alarming devices 510-1 to 510-4 of the present embodiment are installed in the kitchen, living room, master bedroom, and a child's room of a residence 524, and moreover, an alarming device 510-5 is installed in a garage 526 that is built outside.

The alarming devices 510-1 to 510-5 are each provided with a function to mutually transmit and receive wirelessly an event signal, and the five alarming devices 510-1 to 510-5 constitute one group to perform fire monitoring of the entire residence 524.

In the case of a fire occurring for example in the child's room of the residence 524, the alarming device 510-4 detects the fire and starts an alarm. The detection of the fire and starting of the alarm is called "alarm activation" in the alarming device. When the alarming device 510-4 activates an alarm, the alarming device 510-4 functions as the link source, and transmits wirelessly the event signal that indicates a fire alarm activation to the other alarming devices 510-1 to 510-3 and 510-5 that serve as link destinations.

When the other alarming devices 510-1 to 510-3 and 510-5 receive the event signal that indicates fire alarm activation from the alarming device 510-4 that is the link source, they perform an alarm operation as link sources.

As the alarm sound of the alarming device 510-4 that is the link source, for example, the voice message "Woo Woo . . . The fire alarm has been activated. Please confirm" is output continuously. Meanwhile, in the link destination alarming devices 510-1 to 510-3 and 510-5, the voice message "Woo Woo . . . Another fire alarm has been activated. Please confirm" is output continuously. In the state of the alarming devices 510-1 to 510-5 outputting the alarm sound, when the alarm stop switch 520 that is provided on the alarming device shown in FIG. 8A is operated, the stop process of the alarm sound is performed.

Also, the alarming devices 510-1 to 510-5 are provided with a failure monitoring function, and when it detects a failure, for example, it intermittently outputs a "beep" alarm sound at a predetermined time interval, and reports that a failure has occurred. Also, the failure source alarming device that has detected the failure wirelessly transmits an event signal that indicates a failure occurrence to the other alarming devices, and in the other alarms units as well, the same failure alarm is output. As a result, when a failure is detected in any alarming device, a failure alarm is output from all of the alarming devices that constitute the group that performs linked alarms.

The failure alarm that is output from the alarming device can be stopped by operating the alarm stop switch 520. In the present embodiment, failures that are detected by the alarming device and set off an alarm are chiefly low battery alarms that warn of the detection of a drop in battery voltage, and also include a failure alarm such as a sensor failure in the smoke detector section or the like.

Figure 10:
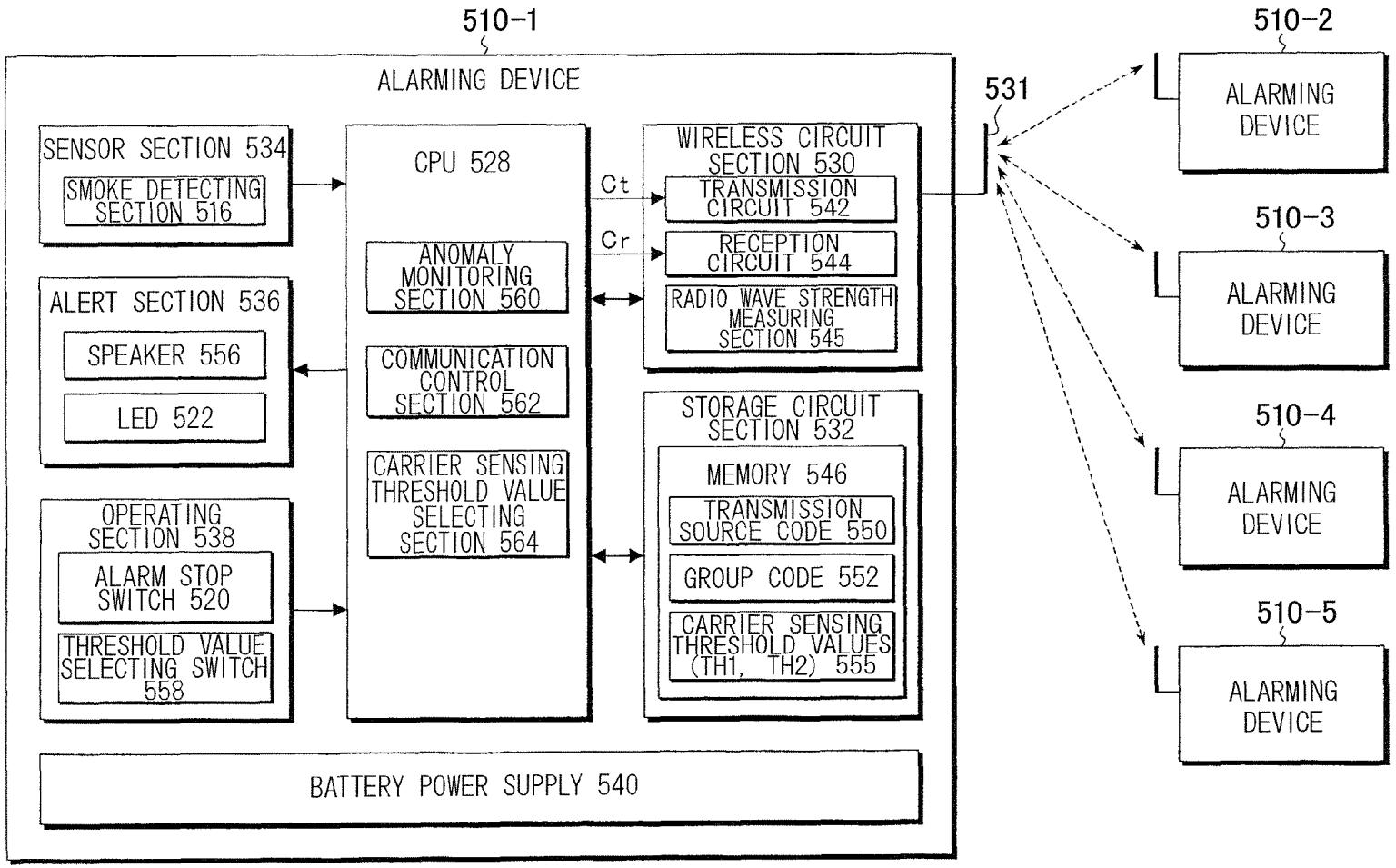
FIG. 10 is a block diagram of the alarm system that is used in the alarming device.

FIG. 10 is a block diagram that shows the constitution of the alarming device of the present embodiment. FIG. 10 shows in detail the circuit configuration of the alarming device 510-1, among the five alarming devices 510-1 to 510-5 shown in FIG. 9.

The alarming device 510-1 is provided with a CPU 528. Also, corresponding to this CPU 528, it is further provided with a wireless circuit section 530 that is provided with an antenna 531, a storage circuit section 532, a sensor section 534, a alert section 536, an operating section 538, and a battery power supply 540.

The wireless circuit section 530 is provided with a transmission circuit 542, a reception circuit 544, and a signal strength measurement section 545, and is designed to be capable of wirelessly transmitting and receiving event signals to/from the other alarming devices 510-2 to 510-5. As the wireless circuit section 530, in Japan it is preferable to adopt a constitution based on for example STD-30, which is known as the standard for specified low-power radio stations in the 400 MHz band (ARIB Standard for Radio Equipment for Radio Station of Low Power Security System), or STD-T67 (ARIB Standard for Telemeter, Telecontrol and Data Transmission Radio Equipment for Specified Low Power Radio Stations).

Of course, as the wireless circuit section 530, for places outside of Japan, it is preferable to adopt a constitution that is based on the standard for allocated radio stations of that region.

The reception circuit 544 performs a discontinuous reception operation. The discontinuous reception operation of the reception circuit 544 consists of a reception operation time of for example T1=5 milliseconds, followed by a sleep time of for example T2=10 seconds, resulting in discontinuous reception with a cycle T12 (=T1+T2). Corresponding to this discontinuous reception, the transmission circuit 542 continuously transmits the event signal over time T3 that is at least the discontinuous reception cycle T12 (=T1+T2).

The signal strength measurement section 545 receives the radio waves of an event signal and measures the radio wave strength, that is, the carrier signal strength. The signal strength measurement section 545 is a circuit that outputs a voltage corresponding to the strength of the radio wave, such that, generally, when the radio wave strength is strong, the output voltage is high, and when the radio wave strength is weak, the output voltage is low.

The discontinuous reception operation of the reception circuit 544 is controlled by a discontinuous reception control section 562 that is provided in the CPU 528. The discontinuous reception control section 562 reads in the carrier signal strength that is measured by the signal strength measurement section 545 at the time of starting the reception operation of the reception circuit 544. When the carrier signal strength is less than a predetermined carrier sensing threshold value, the discontinuous reception control section 562 pauses the operation of the reception circuit 544, and when the carrier signal strength exceeds the carrier sensing threshold value, it performs an event signal reception process by causing the reception circuit 544 to operate over a predetermined time.

Moreover, in the present embodiment, the carrier sensing threshold that is used in determining the existence of a carrier in the discontinuous reception control section 562 can be selected in two levels of high and low in accordance with the radio wave environment by a switch operation of the user.

A memory 546 is provided in the storage circuit section 532. A transmission source code 550 that serves as an ID (identifier) that specifies the alarming device, and a group code 552 for constituting a group that performs a linked alarm with a plurality of alarms as shown in FIG. 9 is housed in the memory 546. As for the transmission source code 550, the number of alarming devices to be provided domestically is calculated, and for example a code of 26 bits is used so that the same code does not overlap.

The group code 552 is a code that is set so as to be common for the plurality of alarming devices that constitute a group, and when the group code that is included in the event signal from another alarming device that is received by the wireless circuit section 530 matches the group code 552 that is registered in the memory 546, that event signal is received as a valid signal and processed.

Moreover, the two carrier sensing threshold values 555 of high and low that are set beforehand for use by the discontinuous reception control section 562 are stored in the memory 546 as TH1 and TH2.

Note that in the present embodiment, the memory 546 is used in the storage circuit section 532, but a DIP switch may be provided instead of the memory 546, so that the transmission source code 550 and the group code 552 may be set by this DIP switch. In the case of the bit length (bit number) of the transmission source code 550 and the group code 552 being short, the storage circuit section 532 that uses a DIP switch is preferred.

In the present embodiment, the smoke detector section 516 is provided in the sensor section 534, and outputs a smoke detection signal corresponding to the smoke density to the CPU 528. Besides the smoke detector section 516, a thermistor that detects the temperature from a fire may be provided. Also, in the case of an alarming device for detecting gas leaks, a gas leak sensor is provided in the sensor section 534. Also, the memory 546 may be provided in a storage region in the CPU 528.

The speaker 556 and the LED 522 are provided in the alert section 536. The speaker 556 outputs a voice message from a speech synthesis circuit section that is not illustrated or an alarm sound. The LED 522, by blinking and flashing, or turning on, indicates an anomaly such as a fire or a failure.

The alarm stop switch 520 and a threshold value selecting switch 558 are provided in the operating section 538. When the alarm stop switch 520 is operated, it is possible to stop the alarm sound that is sounding from the alarming device 510-1. The alarm stop switch 520 also doubles as a check switch in the present embodiment.

The alarm stop switch 520 is in effect when the alert section 536 is outputting an alarm sound from the speaker 556. On the other hand, during the normal monitoring state when an alarm sound is not being output, the alarm stop switch 520 functions as a check switch, and when the check switch is pushed, a voice message for inspection is output from the alert section 536.

A DIP switch that is mounted on a circuit board in the housing is used as the threshold value selecting switch 558. By the function of a carrier sensing threshold value selecting section 564 that is provided in the CPU 528, it is possible to select between the two high-low threshold values TH1 and TH2 as the carrier sensing threshold value 555 of the memory 546 that is used in the discontinuous reception control section 562 in accordance with the radio wave environment of the installation location of the alarming device.

That is, when the alarming device is installed in a location in a radio wave environment in which the noise component is hardly noticeable, the lower carrier sensing threshold value TH1 is selected by the threshold value selecting switch 558. In contrast, when the alarming device is installed in a location with a poor radio wave environment in which the noise component is large, the higher carrier sensing threshold value TH2 is selected by the threshold value selecting switch 558.

The battery power supply 540 uses for example alkaline dry cells of a predetermined number, and regarding the battery capacity, a battery service life of about 10 years is ensured due to the reduced power consumption of the entire circuit section including the wireless circuit section 530 in the alarming device 510-1.

In the CPU 528, an anomaly monitoring section 560, the discontinuous reception control section 562, and the carrier sensing threshold value selecting section 564 are provided as functions that are realized by program execution. Note that the functions of the discontinuous reception control section 562 and the carrier sensing threshold value selecting section 564 are as already described.

When the smoke detection signal from the smoke detector section 516 of the sensor section 534 exceeds the fire level and detects a fire, the anomaly monitoring section 560 causes the repeated output of, for example, "Woo Woo . . . The fire alarm has been activated. Please confirm" as the voice message that is the alarm sound indicating the link source from the speaker 556 of the alert section 536, and transmits an event signal that indicates fire alarm activation from the antenna 531 to the other alarming devices 510-2 to 510-5 by the transmission circuit 542 of the wireless circuit section 530.

Also, when an event signal that indicates fire alarm activation has been received from any of the other alarming devices 510-2 to 510-5 by the reception circuit 544 of the wireless circuit section 530, the anomaly monitoring section 560 causes the voice message "Woo Woo . . . Another fire alarm has been activated. Please confirm" to be output continuously from the speaker 556 of the alert section 536 as an alarm sound indicating the link destination.

Here, when the anomaly monitoring section 560 has detected a fire alarm activation and outputs the link source alarm sound, the LED 522 of the alert section 536 is made to blink, for example. On the other hand, in the case of outputting a link destination alarm sound, the LED 522 of the alert section 536 is made to flash. Thereby, it is possible to distinguish the indication of the LED 522 in the link source alarm and the link destination alarm. Of course, either of the link source alarm and the link destination alarm may be a blinking or flashing display of the LED 522.

Also, when the anomaly monitoring section 560 has detected as a failure a low battery due to a voltage drop of the battery power supply 540, it transmits to the other alarming devices 510-2 to 510-5 an event signal that indicates a failure, together with causing the output of a failure alarm sound by outputting a short low battery alarm sound such as a "beep" once every minute, for example.

Also, when the anomaly monitoring section 560 has received an event signal that indicates a failure from any of the other alarming devices 510-2 to 510-5, by similarly outputting discontinuously a low battery alarm sound, it performs a linked output of a failure alarm sound. The alarm at the link destination of the low battery may consist of causing the LED 522 to blink in synchronization with the alarm sound.

Figure 11:
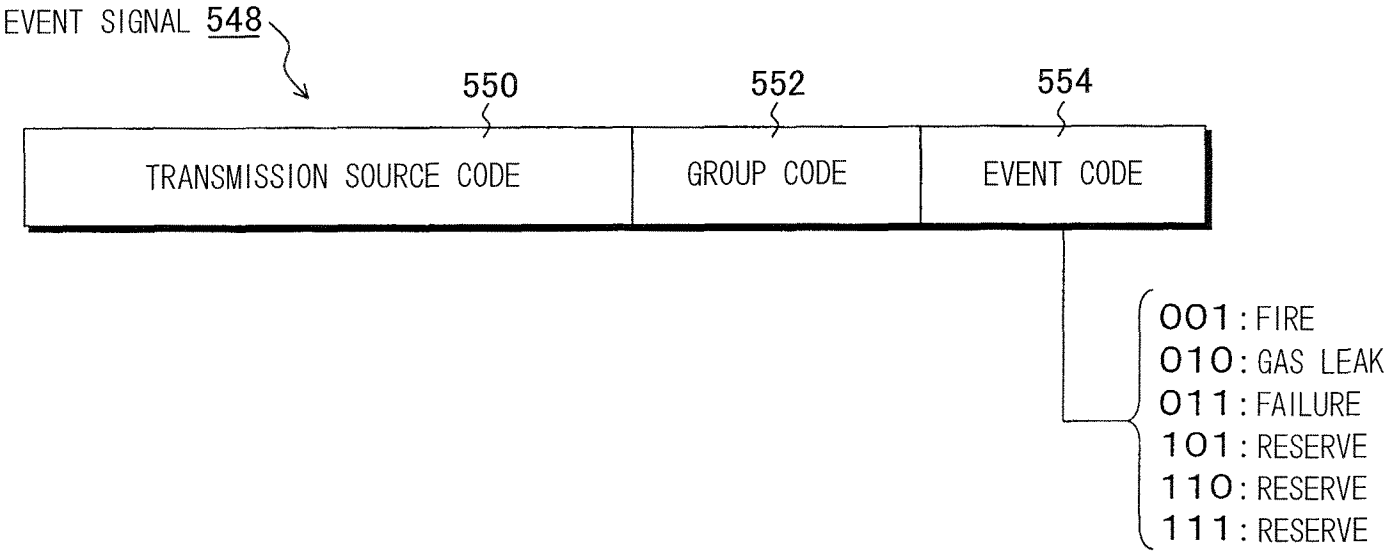
FIG. 11 is an explanatory drawing that shows the format of the event signal that is used in the embodiment.

FIG. 11 is an explanatory drawing that shows the format of the event signal used in the present embodiment. An event signal 548 as shown in FIG. 11 is constituted by the transmission source code 550, the group code 552, and the event code 554. The transmission source code 550 is for example a code of 26 bits. Also, the group code 552 is for example a code of 8 bits, and the same group code is set for the five alarming devices 510-1 to 510-5 of FIG. 11, for example, that constitute the same group.

Note that as the group code 552, the same group code may be set for each alarming device of the same group, but in addition, it may be a group code differing for each alarming device that is found from arithmetic of a reference code that is common to each alarming device that constitutes a group that is defined in advance, and a transmission source code that is unique to each alarming device.

The event code 554 is a code that expresses the event convent of an anomaly such as a fire or gas leak or a failure. In the present embodiment, a three-bit code is used, with for example "001" denoting a fire, "010" denoting a gas leak, "011" denoting a failure, and the remainder serving as a reserve.

Note that by increasing the bit number of the event code 554 to four bits or five bits when the type of events has increased, it is possible to express several types of event contents.

Figure 12:
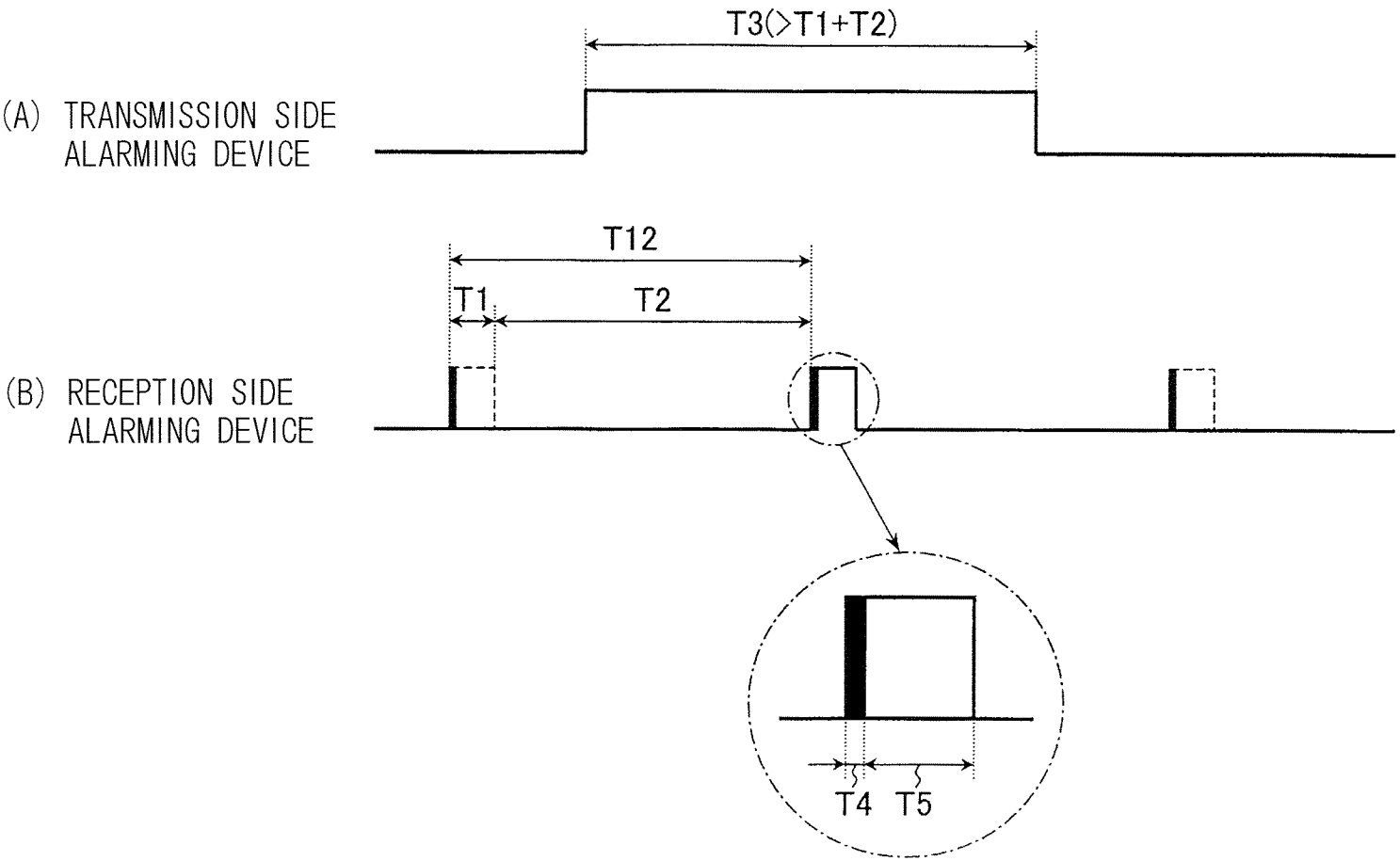
FIG. 12 is a time chart that shows the discontinuous reception operation in the embodiment.

FIG. 12 is a timechart that shows the discontinous reception operation in the present embodiment. (A) of FIG. 12 is the transmission operation of the transmission side alarming device, and (B) is the reception operation of the reception side alarming device.

As shown in (B) of FIG. 12, the reception side alarming device performs a discontinuous reception operation by the discontinuous reception cycle T12 (=T1+T2) that includes the reception operation time T1 and the sleep time T2. For example, in the case of the reception operation time T1 being T1=5 milliseconds, and the sleep time T2 being 10 seconds, the discontinuous reception cycle T12 becomes T12=approximately 10 seconds.

As shown in further detail by the enlarged part of the drawing, the reception operation time T1 includes the carrier sensing time T4 directly after the start of the reception operation, and the reception operation time T5 thereafter. The carrier sensing time T4 is the time of executing the carrier sensing by the discontinuous reception control section 562 of the CPU 528 shown in FIG. 10, each time the discontinuous reception cycle T12 is reached.

The carrier signal strength that is measured by the signal strength measurement section 545 is read into the CPU 528, and in the discontinuous reception control section 562 of the CPU 528 shown in FIG. 10, is compared with the carrier sensing threshold value that is set by selection with the carrier sensing selecting section 564, and in the case of being equal to or greater than the threshold value, the determination of "carrier present" is made. Then, the reception operation is performed over the carrier sensing time T4 and the reception operation time T5 as shown in the enlargement of (B) in FIG. 12.

The reception signal that is received in the reception operation time T5 is read into the CPU 528, and is used in the monitoring process by the anomaly monitoring section 560 shown in FIG. 10.

On the other hand, in the case of the carrier signal strength that is measured by the signal strength measurement section 545 being less than the carrier sensing threshold value, the determination of "carrier absent" is made, and the reception operation is immediately stopped and then put in sleep mode. That is, the operation of the transmission circuit 542 and the reception circuit 544 that had been operating for carrier sensing are stopped, and enter the sleep operation until the next discontinuous reception cycle.

As shown in (A) of FIG. 12, the transmission side alarming device, in the case of having detected a fire at an appropriate timing, repeatedly and continuously transmits the event signal 548 in which the event code 554 shown in FIG. 11 is for example set to "001" of fire over the time T3 that is equal to or greater than the discontinuous reception cycle T12. Accordingly, over this transmission time T3, the reception side alarming device receives the radio waves of the carrier frequency that includes the event signal.

As shown in (A) of FIG. 12, the timing of the second reception operation time T1 shown in (B) of FIG. 12 is overlapped by the timing of the transmission signal with the transmission time T3. Accordingly, in this case, the carrier signal strength becomes the carrier sensing threshold value or more during the first carrier sensing time T4 of the reception operation time Ti, and then the reception operation is performed over the reception operation time T5, whereby the transmitted event signal is received.

In contrast to this, there is no transmitted signal at the timing of the reception operation time T1 before and after the transmission time T3. For that reason, since the carrier signal strength that is measured by the signal strength measurement section 545 is less than the carrier sensing threshold value, a determination of "no carrier" is made, and it enters the sleep mode directly after the carrier sensing time T4.

Figure 13:
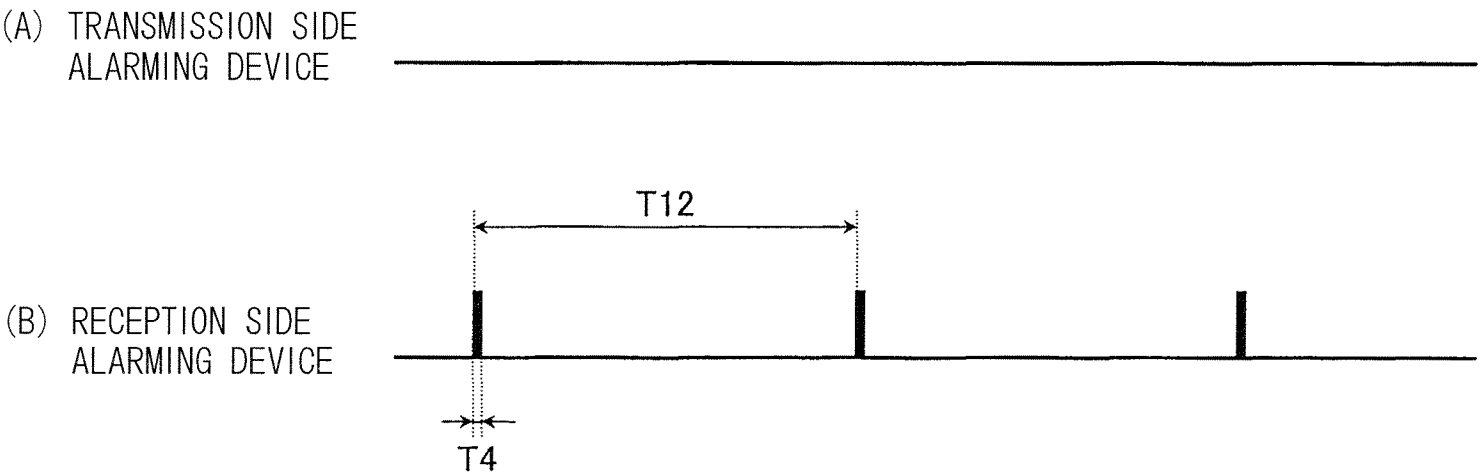
FIG. 13 is a time chart that shows the discontinuous reception operation in the case of entering sleep mode without performing carrier sensing.

FIG. 13 is a time chart that shows the discontinuous reception operation in the case of the determination of "no carrier" being made and entering the sleep mode. (A) of FIG. 13 denotes the transmission operation of the transmission side alarming device, and (B) denotes the reception operation of the reception side alarming device. The reception side alarming device performs the discontinuous reception operation at each discontinuous reception cycle T12, but since the carrier signal strength that is detected at the timing of the carrier sensing time T4 immediately after the reception operation is less than the carrier sensing threshold value, at the point in time of the passage of the carrier sensing time T4, it enters the sleep mode, and thereafter does not perform the reception operation over the reception operation time T5.

The carrier sensing time T4 in the discontinuous reception operation shown in the enlargement in (B) of FIG. 12 is approximately 1 millisecond, and the reception operation time T5 that continues therefrom is approximately 4 milliseconds.

For this reason, as shown in (B) of FIG. 13, in the discontinuous reception operation during the "carrier absent" sleep mode, the reception operation is only performed for the carrier sensing time T4=1 millisecond at every discontinuous reception cycle T12. For this reason, it is possible to significantly reduce the current consumption in the state of there being no carrier.

However, as shown in (A) of FIG. 13, in the state of there being no transmission of an event signal from the transmission side alarming device, that is, in the state of a carrier not being present, in a poor radio wave environment in which the noise component is large, due to the noise that includes the carrier frequency, a determination of "carrier present" may end up being made. In this case, regardless of the noise, since the reception operation over the reception operation time T5 that is enlarged in (B) of FIG. 12 ends up being unnecessarily performed, there is a risk of wasteful current consumption.

In order to prevent such wasteful current consumption, in the present embodiment, in the case of installing the alarming device in a location in which the noise component is large and the radio wave environment is poor, the threshold value selecting switch 558 that is provided in the operation section 538 shown in FIG. 10 is switched to the position that selects the higher carrier sensing threshold value. Thereby, the carrier sensing threshold value selecting section 564 selects the higher carrier sensing threshold value TH2 that is stored in the memory 546, and sets this for the discontinuous reception control section 562.

For this reason, even if a carrier signal strength due to the noise component is output from the signal strength measurement section 545, since the higher carrier sensing threshold value TH2 has been set, "carrier present" is not unnecessarily detected due to the noise component. For that reason, since it prevents the performance of the reception operation over the reception operation time T5 after the passage of the carrier sensing time T4, and reliably enters the sleep mode, it is possible to reliably perform a reduction the consumption current even if there is a noise component.

Figure 14:
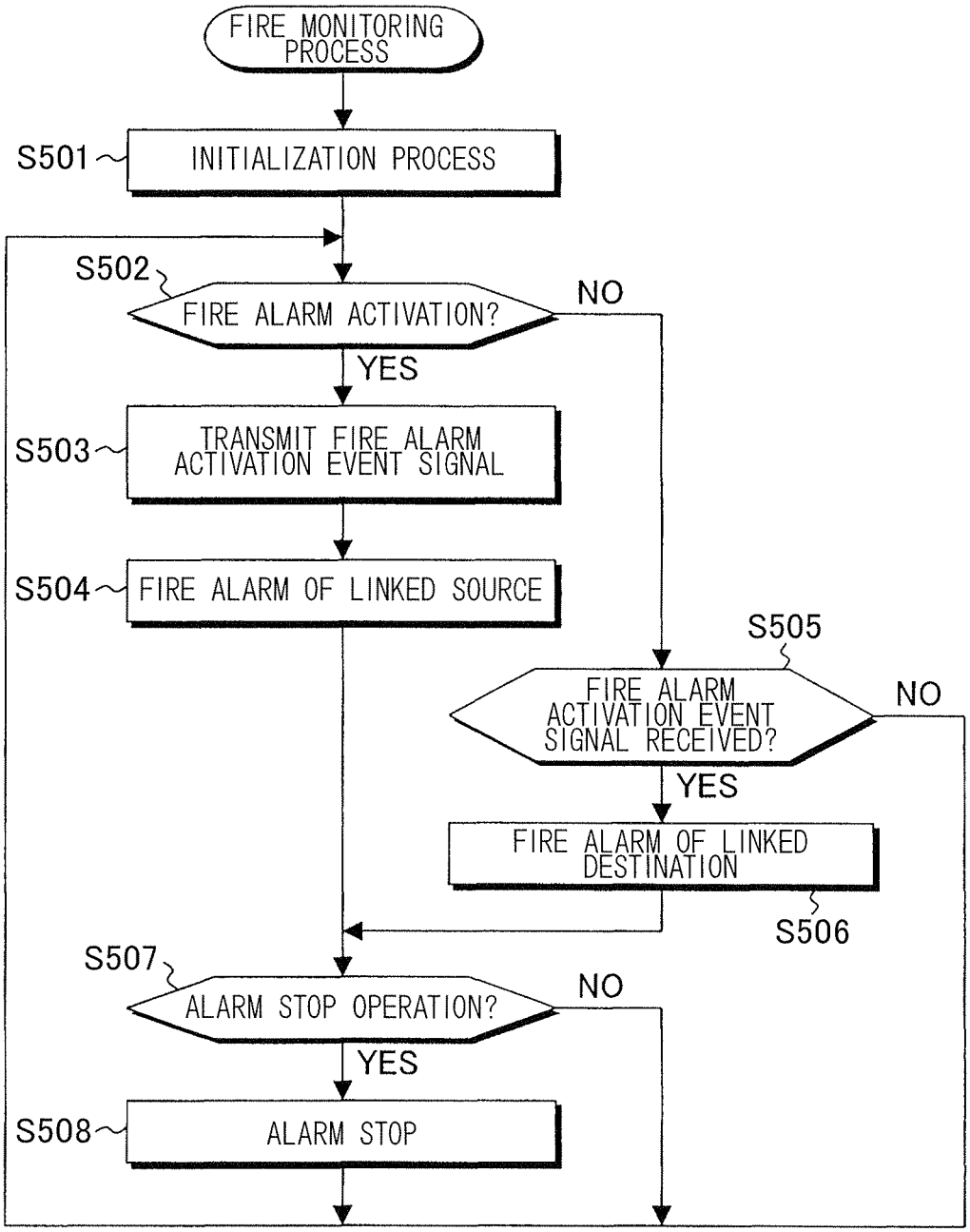
FIG. 14 is a flowchart that shows the fire monitoring process in the embodiment by the CPU of FIG. 10.

FIG. 14 is a flowchart that shows the fire monitoring process by the CPU 528 that is provided in the alarming device 510-1 of FIG. 10. When the battery power supply of the alarming device is made effective (ON), in Step 5501, an initialization process is performed. This initialization process includes the setting of the group code for constituting a linked alarm group with the other alarming devices 510-2 to 510-5.

Next, the alarming device enters the monitoring state, and in Step S502, the presence of a fire alarm activation is determined by whether or not the smoke detection signal from the smoke detector section 516 of the sensor section 534 exceeds a predetermined fire level. In Step S502, in the case of a fire alarm activation being determined, the process proceeds to Step S503. After an event signal of fire alarm activation is transmitted to the other alarming devices 510-2 to 510-5 in Step S503, in Step S504, the fire alarm activation is acoustically output from the speaker 556 of the alert section 536 of each alarming device 510-2 to 510-5 of the link destination, and the LED 522 is controlled to turn on.

After each alarming device 510-2 to 510-5 of the link destination performs the fire alarm activation, in Step S507, the presence of an alarm stop operation by the alarm stop switch 530 is determined. Then, if there is an alarm stop operation, the alarm stoppage is performed in Step S508.

Meanwhile, in the case of a fire alarm activation not being determined in Step S502, in Step S505, the presence of the reception of a fire alarm activation event signal from the other alarming devices 510-2 to 510-5 is checked. In the case of the reception of a fire alarm activation event signal being determined, the fire alarm activation of the link destination is output in Step S506, and the process proceeds to Step S507. Then, if there is an alarm stop operation in Step S507, the alarm activation is stopped in Step S508.

Figure 15:
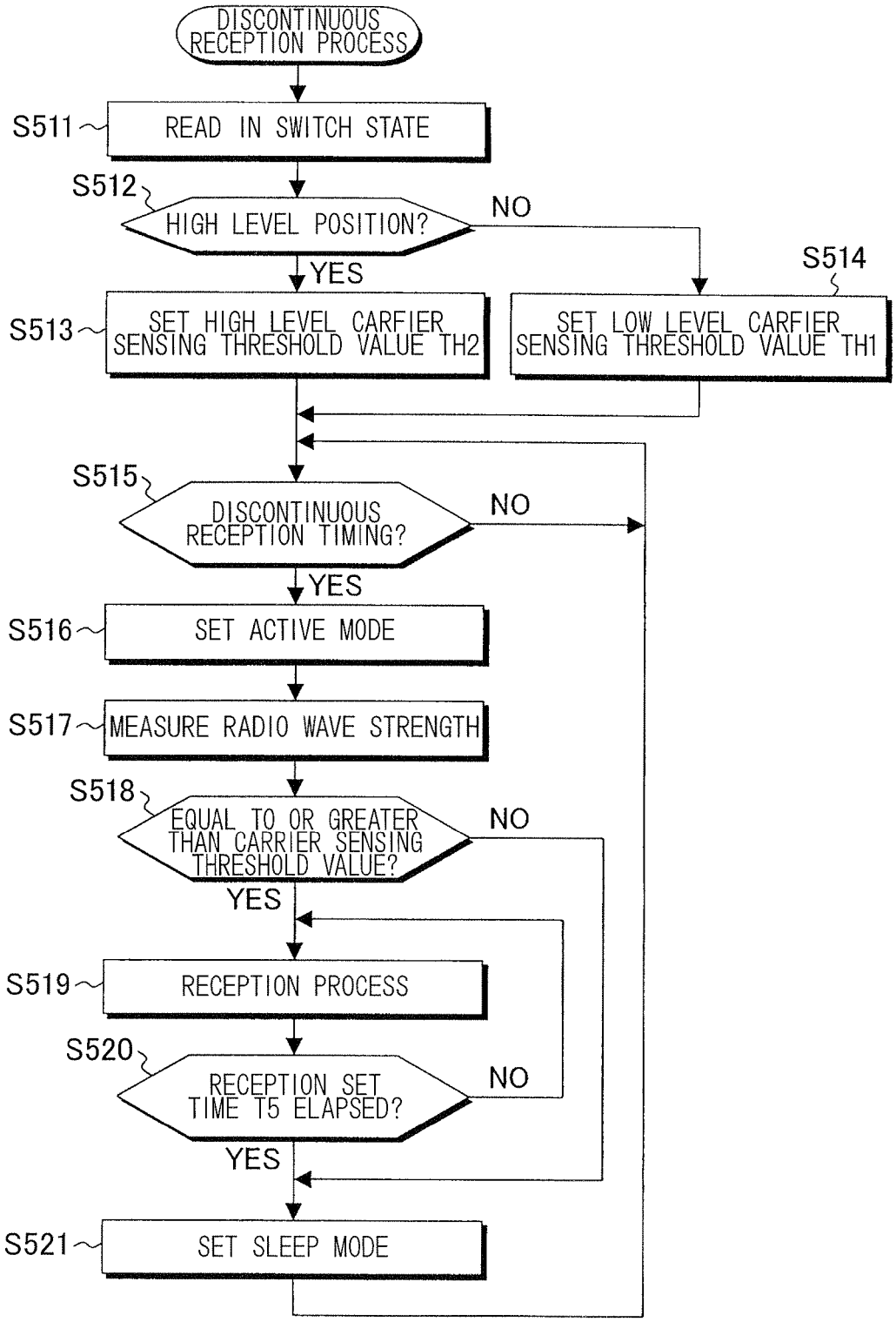
FIG. 15 is a flowchart that shows the discontinuous reception process in the embodiment by the CPU of FIG. 10.

FIG. 15 is a flowchart that shows the discontinuous reception process of the present embodiment by the CPU 528 of FIG. 10. The discontinuous reception process of the present embodiment first reads in the switch state of the threshold value selecting switch 558 that is provided in the operation section 538 in Step S511. Then, in Step S512, when the determination is made that it is at the high-level switch position, the process proceeds to Step S513. In Step S513, the higher carrier sensing threshold value TH2 among the carrier sensing threshold values 555 that are housed in the memory 546 is selected, and this is set to the discontinuous reception control section 562.

On the other hand, in the case of the low-level switch position being determined in Step S502, in Step S514, the lower threshold value TH1 among the carrier sensing threshold values 555 that are housed in the memory 516 is selected, and this is set to the discontinuous reception control section 562.

When the initialization of the carrier sensing threshold value for discontinuous reception is completed, the process proceeds to Step S515, where it is determined whether or not there is a discontinuous reception timing for each discontinuous reception cycle T12. In the case of a discontinuous reception timing being determined, the process proceeds to Step S516, and the active mode is set for the transmission and reception circuit section 530.

Specifically, as shown in FIG. 10, simultaneously with outputting a transmission operation control signal Ct from the CPU 528 to the transmission circuit 542, it outputs a reception operation control signal Cr to the reception circuit 544, and performs power supply to the transmission circuit 542 and the reception circuit 544.

Next, in the Step S517, it reads in the measurement value of the carrier signal strength of the received radio wave measured by the signal strength measurement section 545. In Step S518, it determines whether or not the measurement value of the carrier signal strength of the received radio wave is equal to or greater than the carrier sensing threshold value TH1 or TH2 that is set at this time. In the case of being equal to or greater than the carrier sensing threshold value, it proceeds to Step S519, in which the reception process is performed, and this reception process is maintained in Step S520 until the passage of the reception operation time T5 that in enlarged in (B) of FIG. 12. After the passage of the reception operation time T5, the process proceeds to Step S521, and the sleep mode is set.

On the other hand, in the case of the carrier signal strength being less than the carrier sensing threshold value in Step S518, it proceeds to Step S521, and sets the sleep mode.

Figure 16:
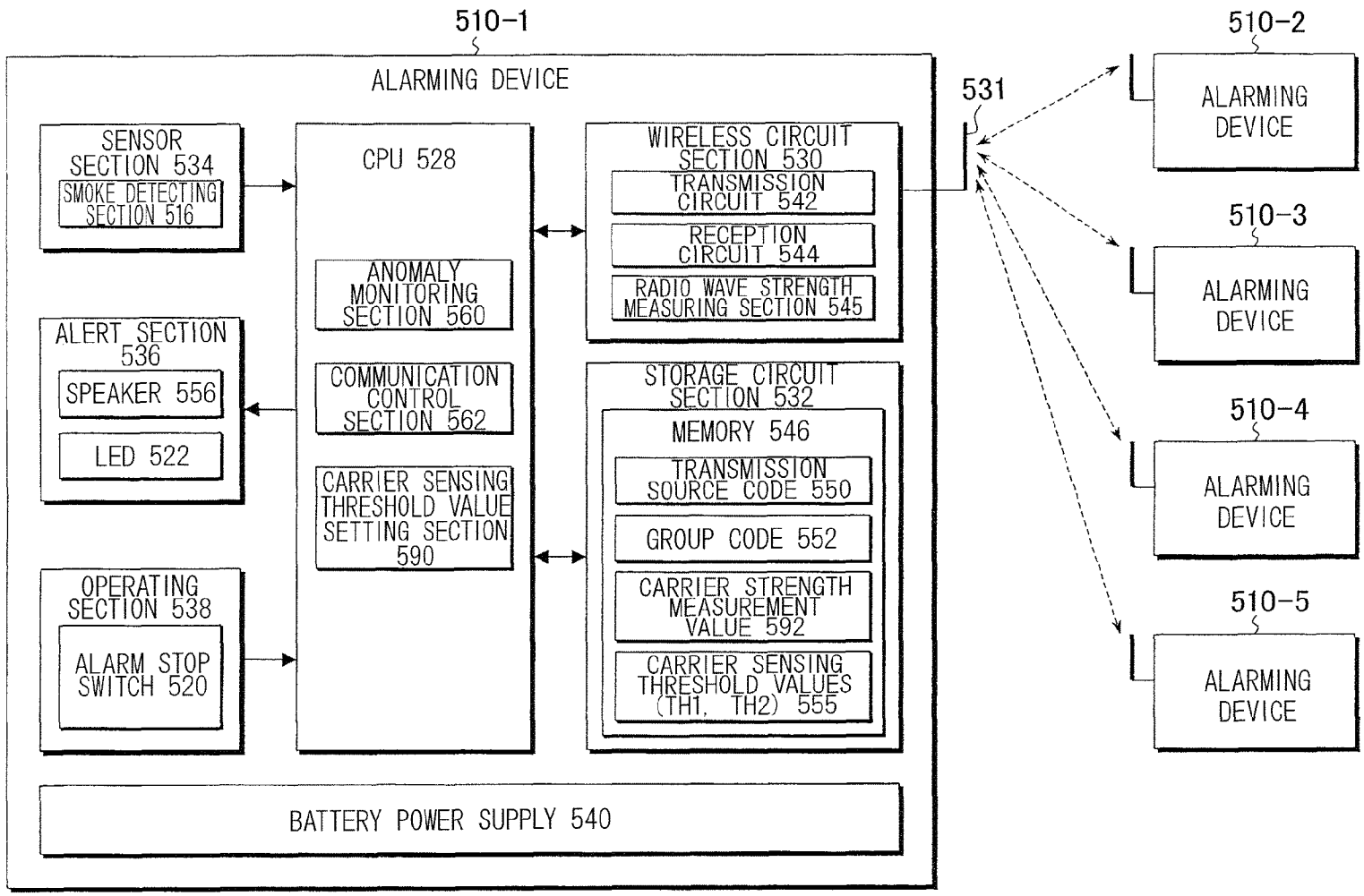
FIG. 16 is block drawing of an alarm system that uses the alarming device of another embodiment of the present invention.
Figure 17:
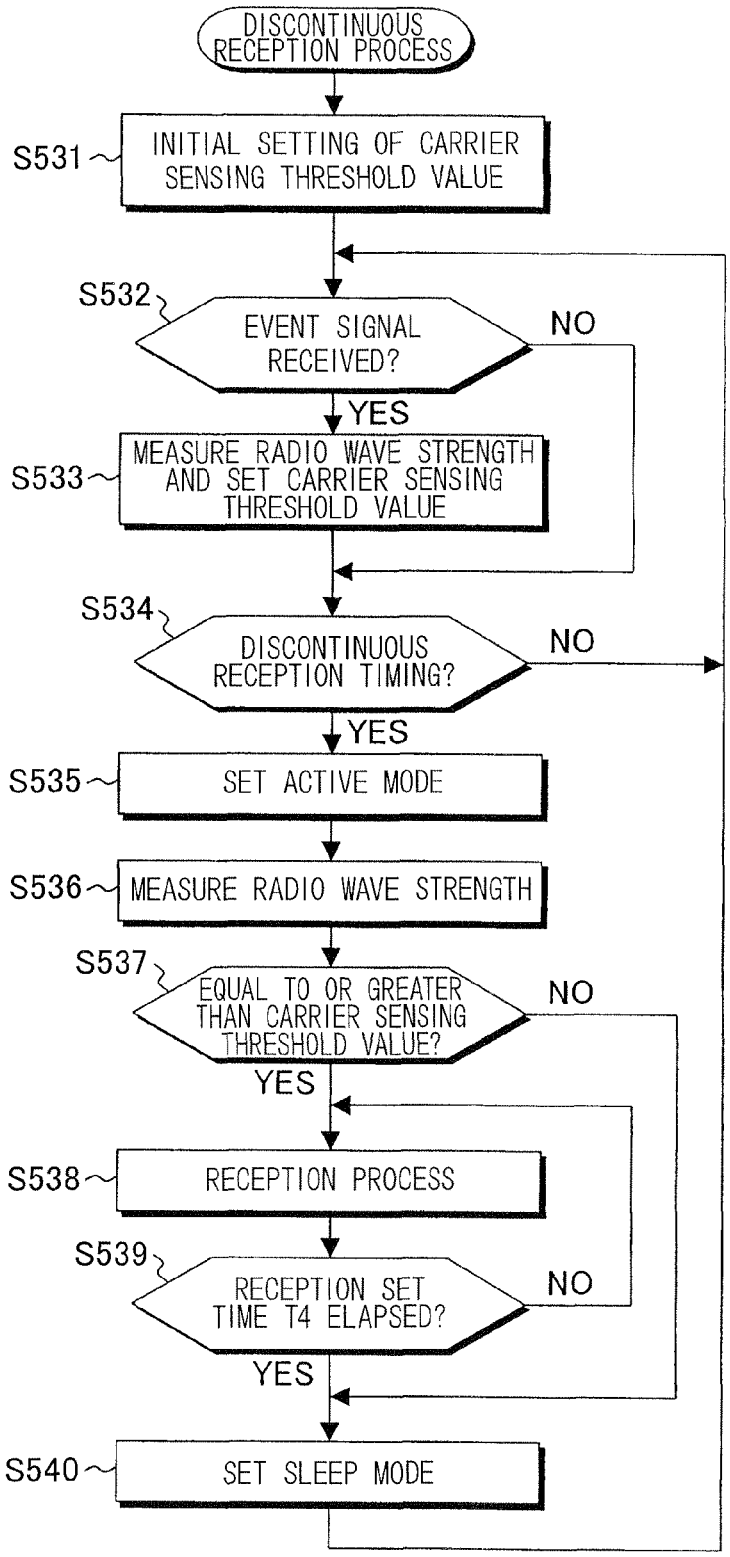
FIG. 17 is a flowchart that shows the discontinuous reception process in another embodiment by the CPU of FIG. 16.

FIG. 16 is a block diagram that shows the alarming device of another embodiment. In this embodiment, the carrier sensing threshold value is automatically set based on the reception field strength in the case of having received an event signal from another alarming device, that is, the carrier signal strength.

In FIG. 16, the circuit configuration of the alarming device 510-1 is basically the same as the embodiment of FIG. 10. The carrier sensing threshold value setting section 590 that is provided in the CPU 528 in the case of receiving an event signal from any of the other alarming devices 510-2- to 510-5, reads in the measurement value of the carrier signal strength that is obtained by the signal strength measurement section 545 provided in the wireless circuit section 530. The carrier sensing threshold value is found in accordance with the measurement value of the carrier signal strength, and this carrier sensing threshold value is set for the discontinuous reception control section 562.

For this reason, the carrier signal strength measurement value during event signal reception that is measured by the signal strength measurement section 545 is saved in the memory 546 over a predetermined period as a carrier signal strength measurement value 592. When this predetermined period elapses, the carrier sensing threshold value setting section 590 reads out a plurality of the carrier signal strength measurement values 592 that are stored in the memory 546, and calculates the average value. The carrier sensing threshold value 555 is calculated by multiplying a coefficient that has a value of 1 or less as the average value of the carrier signal strengths, and this calculated carrier sensing threshold value is set to the discontinuous reception control section 562.

In the calculation of the carrier sensing threshold value, for example, the carrier sensing threshold value TH may be found by setting $\alpha=0.8$ as the coefficient $\alpha$ of less than 1, and multiplying the coefficient $\alpha=0.8$ by the average value that is calculated from a plurality of carrier signal strengths.

Also, in addition to the case of multiplying the coefficient a by the average value of the carrier signal strengths, the carrier sensing threshold value may be set by subtracting a predetermined carrier signal strength, for example, 20 dBm, from the average value of the carrier signal strengths.

Also, since the carrier sensing threshold value that is calculated in the carrier sensing threshold value setting section 590 is meaningless below the reception sensitivity by the reception circuit 544, even the minimum value is restricted to a value that does not go below a reception sensitivity of for example −119 [dBm].

In this way, by the alarming device calculating and setting the carrier sensing threshold value automatically from the carrier signal strength of the event signal that is received in accordance with the installation location, the optimum carrier sensing threshold value is set that conforms to changes in the radio wave environment of the installation location of the alarming device. For this reason, even in the case of the alarming device being installed in an environment in which the noise component is great, since it is not influenced by the noise component, when in the state of no event signal being received, that is, in the case of no carrier sensing, it immediately enters the sleep mode. Thereby, it is possible to reliably perform a reduction of the current consumption.

Note that in the aforementioned embodiment, the discontinuous reception control section 562, the carrier sensing threshold value selecting section 564, the carrier sensing threshold value setting section 590 are provided as functions that are realized by the execution of programs by the CPU 528, but these functions may also be realized by providing dedicated digital circuits for the transmission circuit 542 and the reception circuit 544 of the wireless circuit section 530.

Also, in the embodiment of FIG. 9, the selection of one of the two carrier sensing threshold values of large and small by the threshold value selecting switch 558 was taken as an example, but a selection may also be made from among three or more carrier sensing threshold values.

Also, the aforementioned embodiment is one that takes as an example an alarming device that is intended for fire detection, but it is possible to apply as is the monitoring process that includes the preliminary anomaly of the present embodiment for an alarming device that detects other anomalies, such as an alarming device for gas leaks or an alarming device for crime prevention. Also, it is not limited to residences, and can be also applied to alarming devices catering to various uses such as for buildings and offices.

Also, the aforementioned embodiment is one that takes as an example the case of the sensor section being integrally provided in the alarming device, but as another embodiment it may also be an alarming device in which the sensor section is provided separately from the alarming device.

Also, the present invention is not limited to only the aforementioned embodiments, and includes suitable modifications that do not impair the objectives and advantages thereof, and furthermore is not subject to limitations by only the numerical values shown in the aforementioned embodiments.

INDUSTRIAL APPLICABILITY

According to the alarming device of the present invention, it is possible to extend the battery life by reducing the current consumption of the transmission and reception circuit section as much as possible.

Reference Numerals

10, 10-1~10-5: alarming device
12: cover
14: main unit
15: mounting hook
16: smoke detector section
18: sound hole
20: alarm stop switch
22: LED
24: residence
26: garage
28: CPU
30: wireless circuit section
31: antenna
32: storage circuit section
34: sensor section
36: alert section
38: operating section
40: battery power supply
42: transmission circuit
44: reception circuit
46: memory
48: event signal
50: transmission source code
52: group code
54: event code
58: speaker
60: anomaly monitoring section
62: communication control section
510, 510-1~510-5: alarming device
512: cover
514: main unit
515: mounting hook
516: smoke detector section
518: sound hole
520: alarm stop switch
522: LED
524: residence
526: garage
528: CPU
530: wireless circuit section
531: antenna
532: storage circuit section
534: sensor section
536: alert section
538: operating section
540: battery power supply
542: transmission circuit
544: reception circuit
545: signal strength measurement section
546: memory
548: event signal
550: transmission source code
552: group code
554: event code
555: carrier sensing threshold value
556: speaker
558: threshold value selecting switch
560: anomaly monitoring section
562: discontinuous reception control section
564: carrier sensing threshold value selecting section
590: carrier sensing threshold value setting section
592: carrier signal strength measurement value

The invention claimed is:

1. An alarming device comprising:

a battery power supply;

a sensor section that outputs an anomaly detection signal in a case of detecting an anomaly;

an alert section that outputs an anomaly alarm based on the anomaly detection signal;

a reception circuit section that includes a signal strength measurement section and receives an event signal from another alarming device;

a transmission circuit section that transmits the event signal to the other alarming device;

an anomaly monitoring section that, when the sensor section has detected an anomaly, causes the alert section to output the anomaly alarm based on the anomaly detection signal and causes the transmission circuit section to transmit the event signal according to the anomaly of the alarming device to the other alarming device, and on the other hand, when the reception circuit section has received the event signal according to an anomaly of the other alarming device from the other alarming device, causes the alert section to output the anomaly alarm; and a communication control section that judges whether or not the following predetermined events occur:

a reduction in a voltage of the battery power supply to a predetermined value or less; and an anomaly of the transmission circuit section or the reception circuit section, wherein the communication control section performs communication control by adjusting the transmission to reduce current consumption and reception of the event signal by the transmission circuit section and the reception circuit section when at least one of the predetermined events is detected, the event signal is a signal which includes a transmission code, a group code and an event code, and is mutually transmitted and received wirelessly, and the alarming device continues monitoring an anomaly so as to output an anomaly alarm upon detection of an anomaly, after the communication control by the communication control section.

2. The alarming device according to claim 1, wherein the communication control section, upon detecting the predetermined event, performs control that causes stoppage of the transmission of the event signal by the transmission circuit section and the reception of the event signal by the reception circuit section.

3. The alarming device according to claim 1, wherein the communication control section, upon detecting the predetermined event, performs control that lowers the transmission power by the transmission circuit section.

4. The alarming device according to claim 1, wherein the communication control section, upon detecting the predetermined event, performs control that stops the reception of the event signal by the reception circuit section.

5. The alarming device according to claim 1, wherein the reception circuit section receives the event signal from the other alarming device by discontinuously performing a reception operation at every predetermined receiving period; and the transmission circuit section transmits to the other alarming device the event signal over a transmission time that is equal to or greater than the receiving period.

6. An alarming device comprising:

a sensor section that outputs an anomaly detection signal in a case of detecting an anomaly;

an alert section that outputs an anomaly alarm based on the anomaly detection signal;

a reception circuit section that receives an event signal from another alarming device by discontinuously performing a reception operation at every predetermined receiving period;

a transmission circuit section that transmits to the other alarming device the event signal over a transmission time that is equal to or greater than the receiving period;

an anomaly monitoring section that, when the sensor section has detected an anomaly, causes the alert section to output the anomaly alarm based on the anomaly detection signal and causes the transmission circuit section to transmit the event signal according to the anomaly of the alarming device to the other alarming device, and on the other hand, when the reception circuit section has received the event signal according to an anomaly of the other alarming device from the other alarming device, causes the alert section to output the anomaly alarm;

a carrier signal strength measuring section that receives the event signal and measures the carrier signal strength; and a discontinuous reception control section that, when the reception circuit section starts the reception operation, causes the carrier signal strength measuring section to measure the carrier signal strength, and, in the case of the measured carrier signal strength being less than a predetermined carrier sensing threshold value, causes the reception operation of the reception circuit section to sleep, and on the other hand in the case of the measured carrier signal strength exceeding the carrier sensing threshold value, causes the reception operation of the reception circuit section to be performed over a predetermined time, wherein the predetermined carrier sensing threshold value is suitably changeable.

7. The alarming device according to claim 6, further comprising a carrier sensing threshold value selecting section in which two carrier signal strength values of high and low are settable in advance as candidates of the carrier sensing threshold value, and by selecting either one of the two carrier sensing threshold value candidates that has been set, sets it as the carrier sensing threshold value.

8. The alarming device according to claim 6, further comprising a carrier sensing threshold value setting section that finds the carrier sensing threshold value based on the carrier signal strength that is measured when the reception circuit section starts the reception operation.

9. The alarming device according to claim 8, wherein the carrier sensing threshold value setting section finds the carrier sensing threshold value based on the average value of the carrier signal strength that is measured by the signal strength measurement section over a predetermined period.

* * * * *